US007333743B2

(12) United States Patent
Kishi et al.

(10) Patent No.: US 7,333,743 B2
(45) Date of Patent: Feb. 19, 2008

(54) FIXING DEVICE, IMAGE FORMING APPARATUS INCLUDING THE FIXING DEVICE, AND FIXING METHOD

(75) Inventors: Kazuhito Kishi, Yokohama (JP); Susumu Matsusaka, Yokohama (JP); Yasuhisa Kato, Hiratsuka (JP); Akiyasu Amita, Yokohama (JP); Masami Okamoto, Yamato (JP); Yasutada Tsukioka, Matsudo (JP); Hiromasa Takagi, Tokyo (JP); Ryuichi Kikegawa, Miyagi-ken (JP)

(73) Assignee: Ricoh Company, Ltd., Tokyo (JP)

( * ) Notice: Subject to any disclaimer, the term of this patent is extended or adjusted under 35 U.S.C. 154(b) by 80 days.

(21) Appl. No.: 11/221,838

(22) Filed: Sep. 9, 2005

(65) Prior Publication Data

US 2006/0051120 A1 Mar. 9, 2006

(30) Foreign Application Priority Data

Sep. 9, 2004 (JP) ..... 2004-262589

(51) Int. Cl.
*G03G 15/20* (2006.01)

(52) U.S. Cl. ..... 399/69; 399/334

(58) Field of Classification Search ..... 399/67, 399/69, 122, 330, 328, 334
See application file for complete search history.

(56) References Cited

U.S. PATENT DOCUMENTS 4,843,214 A 6/1989 Higashi et al.
5,481,350 A 1/1996 Yasui et al.
5,729,798 A 3/1998 Yasui et al.
5,745,247 A 4/1998 Yasui et al.
5,854,465 A 12/1998 Kishi et al.
6,144,832 A 11/2000 Nimura et al.

(Continued)

FOREIGN PATENT DOCUMENTS

JP 2002-184554 6/2002

(Continued)

OTHER PUBLICATIONS

U.S. Appl. No. 11/405,448, filed Apr. 18, 2006, Kishi et al.

(Continued)

*Primary Examiner*—David M. Gray
*Assistant Examiner*—Joseph S. Wong
(74) *Attorney, Agent, or Firm*—Oblon, Spivak, McClelland, Maier & Neustadt, P.C.

(57) ABSTRACT

A fixing device for fixing an image formed on a recording material includes first and second rotary members having a nip part therebetween, a heating part that heats the first rotary member, a center portion temperature detecting unit that detects a temperature of a center portion of the first rotary member, and an end portion temperature detecting unit that detects a temperature of an end portion of the first rotary member. When recording materials each having a relatively large width consecutively pass through the nip part, a control unit controls a heating amount of a full width heating member based on the temperature detected by the center portion temperature detecting unit, and when recording materials each having a relatively small width consecutively pass through the nip part, the control unit controls the heating amount of the full width heating member based on the temperature detected by the end portion temperature detecting unit.

20 Claims, 16 Drawing Sheets

U.S. PATENT DOCUMENTS

| | | | | |
|---|---|---|---|---|
| 6,542,705 | B2 | 4/2003 | Fujita et al. | |
| 6,813,464 | B2 | 11/2004 | Amita et al. | |
| 6,937,827 | B2 | 8/2005 | Katoh et al. | |
| 2002/0094212 | A1* | 7/2002 | Suzumi | 399/69 |
| 2003/0086736 | A1* | 5/2003 | Sekiguchi et al. | 399/328 |
| 2004/0022552 | A1 | 2/2004 | Yura et al. | |
| 2004/0202490 | A1 | 10/2004 | Okamoto | |
| 2004/0245235 | A1 | 12/2004 | Kishi et al. | |
| 2004/0245241 | A1 | 12/2004 | Kishi et al. | |
| 2004/0247332 | A1 | 12/2004 | Kishi et al. | |
| 2004/0258426 | A1 | 12/2004 | Kishi et al. | |
| 2005/0123315 | A1 | 6/2005 | Kishi et al. | |
| 2005/0139584 | A1 | 6/2005 | Kishi et al. | |
| 2005/0175370 | A1 | 8/2005 | Matsusaka et al. | |

FOREIGN PATENT DOCUMENTS

| | | |
|---|---|---|
| JP | 3670977 | 6/2002 |
| JP | 2002-268421 | 9/2002 |
| JP | 3588006 | 8/2004 |

OTHER PUBLICATIONS

U.S. Appl. No. 11/522,324, filed Sep. 18, 2006, Semma, et al.
U.S. Appl. No. 11/582,991, filed Oct. 19, 2006, Kishi, et al.
U.S. Appl. No. 11/554,944, filed Oct. 31, 2006, Yano, et al.
U.S. Appl. No. 11/609,467, filed Dec. 12, 2006, Kishi, et al.
U.S. Appl. No. 11/678,854, filed Feb. 26, 2007, Yano et al.

* cited by examiner (1): SUPPLYING POWER TO HEATING PART
(2): SUPPLYING POWER TO AUX. POWER SUPPLY UNIT
(3): SUPPLYING POWER TO HEATING PART
(4): CHARGED (1): SUPPLYING POWER TO HEATING PART
(2): SUPPLYING POWER TO AUX. POWER SUPPLY UNIT
(3): SUPPLYING POWER TO HEATING PART
(4): CHARGED

LARGE WIDTH SHEET

LARGE WIDTH SHEET

LARGE WIDTH SHEET

SMALL WIDTH SHEET

SMALL WIDTH SHEET

SMALL WIDTH SHEET

FIXING DEVICE, IMAGE FORMING APPARATUS INCLUDING THE FIXING DEVICE, AND FIXING METHOD

CROSS-REFERENCE TO RELATED APPLICATIONS

This application claims priority to Japanese Patent Application No. 2004-262589 filed in the Japanese Patent Office on Sep. 9, 2004, the entire contents of which is hereby incorporated herein by reference.

BACKGROUND OF THE INVENTION

1. Field of the Invention

The present invention relates to a fixing device and a fixing method in which an image is fixed onto a recording material while supplying power to a heating part of a fixing roller from a power storage unit, and to an image forming apparatus including the fixing device.

2. Discussion of the Related Art

A fixing device that fixes a toner image formed on a recording material, such as a recording sheet, via a heating part having a main heating element and an auxiliary heating element has been widely used. In such a background fixing device, the main heating element is powered by a main power supply unit, and the auxiliary heating element is powered by an auxiliary power supply unit including a capacitor. When the heating part starts to generate heat, the amount of power supplied from the capacitor to the auxiliary heating element is adjusted based on the temperature of the heating part.

Published Japanese patent application No. 2002-184554 describes the above fixing device. In the fixing device, the heating part is rapidly warmed-up to a predetermined temperature by being supplied with a large amount of power from both the main power supply unit and the auxiliary power supply unit. During a stand-by state of the fixing device, the main power supply unit and the auxiliary power supply unit do not supply power to the heating part. Thus, a power-saving effect is enhanced, and noise caused by a sudden current change or an in-rush current at the time of starting or stopping the supply of high power is reduced. Further, a warm-up time of the heating part is reduced, and the heating part is prevented from overheating.

The fixing device further includes a charger, a switching unit, a temperature detecting unit, and a control unit. The charger charges the capacitor of the auxiliary power supply unit with power supplied from the main power supply unit. The switching unit performs switching between the charge of the auxiliary power supply unit and the supply of power from the auxiliary power supply unit to the auxiliary heating element. The temperature detecting unit detects the temperature of the heating part. The control unit controls the amount of power supplied from the auxiliary power supply unit to the auxiliary heating element based on the temperature of the heating part detected by the temperature detecting unit.

Published Japanese patent application No. 2002-268421 describes another fixing device including a center portion heater and an end portion heater. The center portion heater heats around a center portion of a fixing roller in its axial direction, and the end portion heater heats around end portions of the fixing roller in its axial direction. This fixing device makes a temperature distribution uniform in the longitudinal direction of the fixing roller to prevent occurrences of fixing unevenness, wrinkles on a recording material, and a hot offset condition in which a part of a fused toner image carried on a recording material adheres to the fixing roller.

When a plurality of recording materials each carrying an image consecutively pass through a fixing device, the recording materials absorb heat from a fixing roller, thereby decreasing the temperature of the fixing roller. Therefore, it is desirable to prevent the drop in temperature of the fixing roller in such a condition. Further, when a plurality of recording materials each carrying an image and having a small width in a direction perpendicular to a conveying direction of the recording material consecutively pass through the fixing device, the temperature of a center portion of the fixing roller in its axial direction decreases; however, end portions of the fixing roller in its axial direction where the recording material having the small width does not pass through typically overheat. Therefore, it is desirable to control the temperature of the end portions of the fixing roller to prevent overheating of the end portions when a plurality of recording materials each having a small width in a direction perpendicular to a conveying direction of the recording material consecutively pass through the fixing device.

SUMMARY OF THE INVENTION

According to an aspect of the present invention, a fixing device for fixing an image formed on a recording material includes a first rotary member and a second rotary member configured to convey the recording material having an image through a nip part formed between the first rotary member and the second rotary member, to thereby fix the image onto the recording material. The fixing device further includes a heating part configured to heat the first rotary member. The heating part includes a center portion heating member having heating portions disposed around a center portion of the first rotary member in an axial direction of the first rotary member, an end portion heating member having heating portions disposed around end portions of the first rotary member in the axial direction of the first rotary member, and a full width heating member having heating portions disposed across a substantially full width of the first rotary member including the center portion and the end portions.

The fixing device further includes a center portion temperature detecting unit configured to detect a temperature of the center portion of the first rotary member, an end portion temperature detecting unit configured to detect a temperature of at least one of the end portions of the first rotary member, and a control unit configured to control a heating amount of the heating part. When a plurality of recording materials each having a relatively large width in a direction perpendicular to a conveying direction of the recording material consecutively pass through the nip part between the first rotary member and the second rotary member, the control unit is configured to control the heating amount of the full width heating member based on the temperature detected by the center portion temperature detecting unit, and when a plurality of recording materials each having a relatively small width in a direction perpendicular to a conveying direction of the recording material consecutively pass through the nip part between the first rotary member and the second rotary member, the control unit is configured to control the heating amount of the full width heating member based on the temperature detected by the end portion temperature detecting unit.

According to another aspect of the present invention, a fixing device for fixing an image formed on a recording material in an image forming apparatus includes a first rotary member and a second rotary member configured to convey the recording material having an image through a nip part formed between the first rotary member and the second rotary member, to thereby fix the image onto the recording material.

The fixing device further includes a power storage unit configured to be charged by an external power source, and a heating part configured to heat the first rotary member. The heating part includes a center portion heating member disposed around a center portion of the first rotary member in an axial direction of the first rotary member and configured to be supplied with power from the external power source, an end portion heating member disposed around end portions of the first rotary member in the axial direction of the first rotary member and configured to be supplied with power from the external power source, and a full width heating member disposed across a substantially full width of the first rotary member including the center portion and the end portions and configured to be supplied with power from the power storage unit.

The fixing device further includes a center portion temperature detecting unit configured to detect a temperature of the center portion of the first rotary member, an end portion temperature detecting unit configured to detect a temperature of at least one of the end portions of the first rotary member, and a control unit configured to control a heating amount of the heating part. When the first rotary member is warmed-up by the heating part during a returning period from when a stand-by state of the image forming apparatus is completed to when the image forming apparatus becomes ready to start an image forming operation, the control unit is configured to control power supply from the storage unit to the full width heating member based on the temperature detected by the end portion temperature detecting unit.

According to another aspect of the present invention, an image forming apparatus includes an image forming device configured to form an image on a recording material, and the above-described fixing device.

According to yet another aspect of the present invention, a method of fixing an image formed on a recording material includes heating around a center portion of a first rotary member in an axial direction of the first rotary member by a center portion heating member; heating around end portions of the first rotary member in the axial direction of the first rotary member by an end portion heating member; heating a substantially full width of the first rotary member including the center portion and the end portions by a full width heating member; conveying the recording material having an image through a nip part formed between the first rotary member and a second rotary member; detecting a temperature of the center portion of the first rotary member; detecting a temperature of at least one of the end portions of the first rotary member; first controlling a heating amount of the full width heating member based on the detected temperature of the center portion of the first rotary member when a plurality of recording materials each having a relatively large width in a direction perpendicular to a conveying direction of the recording material consecutively pass through the nip part between the first rotary member and the second rotary member; and second controlling the heating amount of the full width heating member based on the detected temperature of the at least one of the end portions of the first rotary member when a plurality of recording materials each having a relatively small width in a direction perpendicular to a conveying direction of the recording material consecutively pass through the nip part between the first rotary member and the second rotary member.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
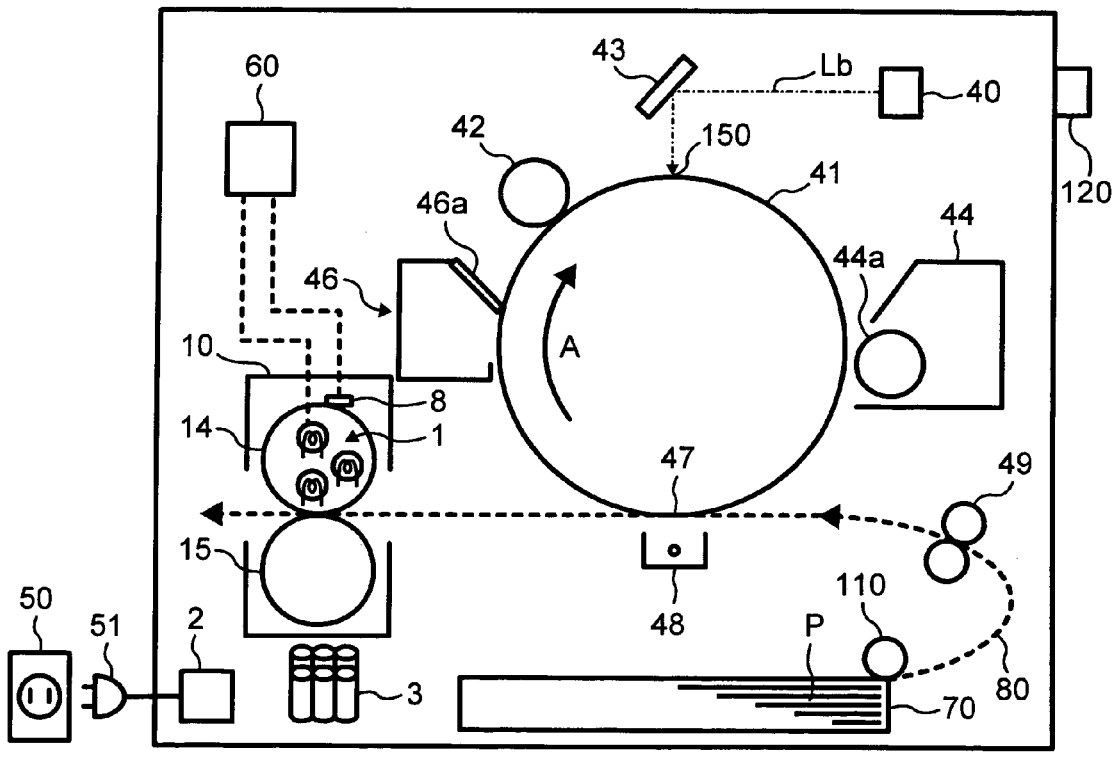
FIG. 1 is a schematic cross sectional view of an image forming apparatus including a fixing device according to an embodiment of the present invention.

Non-limiting embodiments of the present invention are now described with reference to the drawings, wherein like reference numerals designate identical or corresponding parts throughout the several views.

FIG. 1 is a schematic cross sectional view of an image forming apparatus including a fixing device according to an embodiment of the present invention. The image forming apparatus may be a copying machine, a printer, a facsimile machine, or other similar image forming apparatuses. The image forming apparatus includes a drum-shaped photoreceptor 41 acting as an image carrier. Arranged around the photoreceptor 41 are a charging device 42, a mirror 43, a developing device 44, a transfer device 48, and a cleaning device 46 in the order of the rotational direction of the photoreceptor 41 indicated by an arrow A in FIG. 1. Specifically, the charging device 42 includes a charging roller. The mirror 43 constitutes a part of an exposure device 40. The developing device 44 includes a developing roller 44*a*. The transfer device 48 transfers a developed image to a recording material P such as a transfer sheet. The cleaning device 46 includes a blade 46*a* in sliding-contact with the circumferential surface of the photoreceptor 41. Reference numeral 150 in FIG. 1 indicates an exposure portion of the circumferential surface of the photoreceptor 41 located between the charging device 42 and the developing roller 44*a*. The exposure portion 150 is exposed to a laser light beam Lb emitted from the exposure device 40 and reflected by the mirror 43.

The transfer device 48 is disposed opposite to the lower circumferential surface of the photoreceptor 41. Reference numeral 47 in FIG. 1 indicates a transfer section where the transfer device 48 faces the photoreceptor 41. Further, a pair of registration rollers 49 are provided on an upstream side of the transfer section 47 in the rotational direction of the photoreceptor 41. The recording material P is fed out from a sheet feeding cassette 70 by a sheet feeding roller 110 toward the registration rollers 49 while being guided by a sheet conveyance guide plate (not shown). Moreover, a fixing device 10 is disposed on a downstream side of the transfer section 47 in the rotational direction of the photoreceptor 41.

The image forming operation of the image forming apparatus is performed as follows. First, the charging device 42 uniformly charges the rotating photoreceptor 41. Then, the exposure device 40 emits the laser light beam Lb corresponding to image data to the exposure portion 150 of the circumferential surface of the photoreceptor 41, thereby writing a latent image on the surface of the photoreceptor 41. The latent image moves to the developing device 44 by the rotation of the photoreceptor 41, and is developed with toner by the developing device 44. As a result, a toner image is formed on the surface of the photoreceptor 41.

The recording material P, which has been fed out from the sheet feeding cassette 70 by the sheet feeding roller 110, is conveyed through a sheet conveyance path 80 (indicated by dotted lines in FIG. 1) to the registration rollers 49 and stops at a nip part between the registration rollers 49. Then, the registration rollers 49 feed the recording material P toward the transfer section 47 at an appropriate timing so that the recording material P is aligned with the toner image on the photoreceptor 41. Subsequently, the toner image is transferred from the surface of the photoreceptor 41 onto the surface of the recording material P under the influence of the transfer electric field produced in the transfer section 47 by the transfer device 48.

In the above-described image forming apparatus, for example, the exposure device 40, the photoreceptor 41, the charging device 42, the developing device 44, and the transfer device 48 act as an image forming device that forms a toner image on the recording material P. The recording material P having a transferred toner image is conveyed through the sheet conveyance path 80 to the fixing device 10. The fixing device 10 fixes the toner image onto the recording material P by the application of heat and pressure while the recording material P passes through the sheet conveyance path 80 in the fixing device 10. The recording material P having a fixed toner image is discharged to a sheet discharging section (not shown) of the image forming apparatus.

The residual toner which has not been transferred from the photoreceptor 41 to the recording material P is moved to the cleaning device 46 by the rotation of the photoreceptor 41, and is removed from the surface of the photoreceptor 41 by the blade 46*a*. Subsequently, the charging device 42 uniformly charges the surface of the photoreceptor 41 to prepare for a next image forming operation. Reference numeral 120 in FIG. 1 indicates a power switch that turns on and off power to the image forming apparatus.

Figure 2:
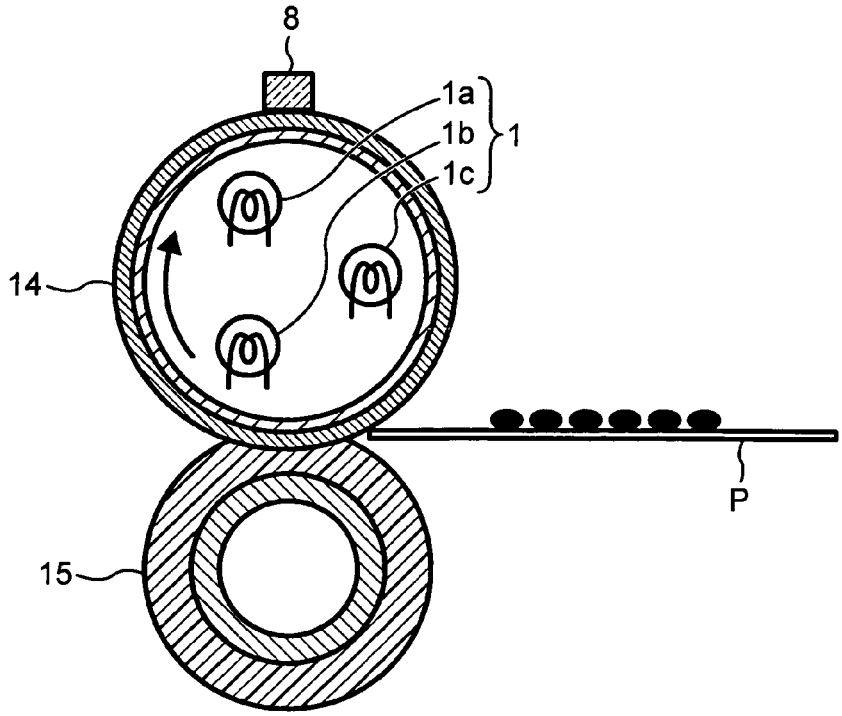
FIG. 2 is a schematic cross sectional view of the fixing device according to an embodiment of the present invention.

FIG. 2 is a schematic cross sectional view of the fixing device 10 according to an embodiment of the present invention. As illustrated in FIG. 2, the fixing device 10 includes a fixing member such as a fixing roller 14 and a pressing member such as a pressing roller 15. The fixing roller 14 has a hollow cylindrical base. In view of durability and possible deformation caused by pressure, the base of the fixing roller 14 is preferably formed from a metallic material, such as aluminum or iron, for example. Further, it is preferable that the circumferential surface of the fixing roller 14 include a releasing layer covering the circumference of the base to prevent toner from being adhered onto the surface of the fixing roller 14. Moreover, the inner circumferential surface of the fixing roller 14 may be blackened to efficiently absorb the heat of heating members 1*a*, 1*b*, and 1*c* (described below).

The pressing roller 15 includes a core metal and an elastic layer made of rubber or the like overlying the core metal. The pressing roller 15 is press-contacted against the fixing roller 14 with a predetermined pressing force by a pressing device (not shown). While the recording material P passes through a nip part between the fixing roller 14 and the pressing roller 15, a toner image is fixed onto the recording material P under the influence of heat and pressure. The pressing roller 15 may include a foamed layer overlying the core metal. In this case, because the heat of the fixing roller 14 does not tend to be transferred to the pressing roller 15 due to the insulation effectiveness of the foamed layer of the pressing roller 15, the fixing roller 14 can be quickly heated up. The fixing device 10 of the present embodiment uses the fixing roller 14 as the fixing member and the pressing roller 15 as the pressing member. Alternatively, the fixing device 10 may use an endless belt or film for at least one of the fixing member and the pressing member.

The fixing device 10 further includes a heating part 1 having an AC heating element 1*a* (hereafter referred to as a main heating member 1*a*), an AC heating element 1*b* (hereafter referred to as a main heating member 1*b*), and a DC heating element 1*c* (hereafter referred to as an auxiliary heating member 1*c*). The main heating members 1*a* and 1*b* and auxiliary heating member 1*c* may be disposed at any desired position where the main heating members 1*a* and 1*b* and the auxiliary heating member 1*c* heat the fixing roller 14. In this embodiment, the main heating members 1*a* and 1*b* and the auxiliary heating member 1*c* are disposed in the fixing roller 14 to heat the fixing roller 14 from inside. The fixing device 10 of FIG. 2 has a construction wherein the fixing roller 14 acts as a heat roller heated by a radiation heater from inside and also acts as a sheet conveyance roller disposed on the sheet conveyance path 80.

With reference to FIGS. 1 and 2, the fixing device 10 further includes a fixing temperature detecting unit 8, and a control unit 60. The fixing temperature detecting unit 8 may be formed by any temperature detecting unit capable of detecting the surface temperature of the fixing roller 14, and the temperature detecting unit does not need to make direct contact with the outer circumferential surface of the fixing roller 14 as long as it can detect the surface temperature of the fixing roller 14. Therefore, various contact type sensors and non-contact type sensors, including a thermistor, a thermocouple, an infrared temperature detector, or the like, may be used for the fixing temperature detecting unit 8. The fixing temperature detecting unit 8 transmits data of temperature information to the control unit 60. The control unit 60 controls the start of the power supply, stopping of the power supply, and an increase or decrease in the amount of power supplied to the heating part 1 of the fixing device 10 based on temperature information obtained by the fixing temperature detecting unit 8.

Figure 3:
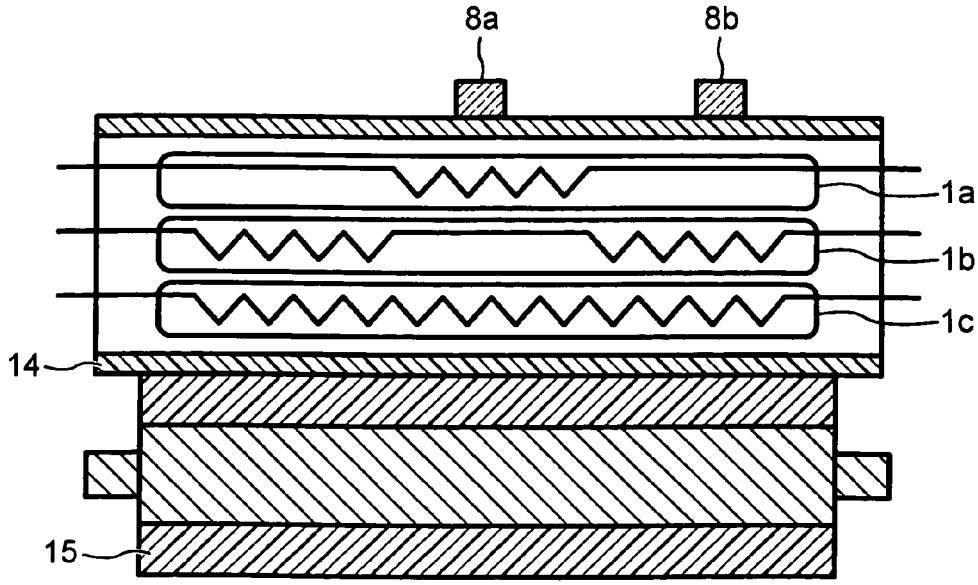
FIG. 3 is a schematic vertical longitudinal sectional view of the fixing device according to an embodiment of the present invention.

FIG. 3 is a schematic vertical longitudinal sectional view of the fixing device according to an embodiment of the present invention. As illustrated in FIG. 3, the fixing temperature detecting unit 8 includes a center portion temperature detecting unit 8*a* and an end portion temperature detecting unit 8*b*. The center portion temperature detecting unit 8*a* is disposed around a center portion of the fixing roller 14 in its axial (i.e., longitudinal) direction where the recording material P of any size passes through. The end portion temperature detecting unit 8*b* is disposed around at least one of the end portions of the fixing roller 14 in its axial (i.e., longitudinal) direction where the recording material P having a small width in a direction perpendicular to a conveying direction of the recording material P (hereafter simply referred to as a sheet conveying direction) does not pass through.

With reference to FIG. 3, the main heating member 1*a* heats by being supplied with power from a main power supply unit 2 (described below), and has heating portions disposed around the center portion of the fixing roller 14 in its axial direction to heat the center portion where the recording material P having a relatively large or small width in a direction perpendicular to a sheet conveying direction passes through. For example, the main heating member 1*a* may be formed from a halogen heater, which can provide a 500 W output at the voltage of 100V, heat the center portion having a width of about 200 mm, and heat an area where an A4 sized sheet in portrait orientation passes through. The main heating member 1*b* heats by being supplied with power from the main power supply unit 2 as well, and has heating portions disposed around the end portions of the fixing roller 14 in its axial direction to heat the end portions where the recording material P having a small width in a direction perpendicular to a sheet conveying direction does not pass through. For example, the main heating member 1*b* may be formed from a halogen heater, which can provide a 700 W output at the voltage of 100V, heat the end portions each having a width of about 310 mm, and heat an area where an A4 sized sheet in landscape orientation passes through. The main heating member 1*b* is configured so as not to heat the center portion having a width of about 200 mm in the axial direction of the fixing roller 14.

The auxiliary heating member 1*c* heats by being supplied with power from a storage unit 3 (described below), and has heating portions disposed across the substantially full width of the fixing roller 14 including the center portion and the end portions to heat the substantially entire area of the fixing roller 14 in its axial direction. For example, the auxiliary heating member 1*c* may be formed from a halogen heater, which can provide a 1200 W output at the voltage of 100V. The halogen heater heats by flowing electric current through a filament formed in a glass tube. Instead of the halogen heater or halogen lamp, the main heating members 1*a* and 1*b* and the auxiliary heating member 1*c* may be formed from induction heaters or ceramic heaters.

Figure 4:
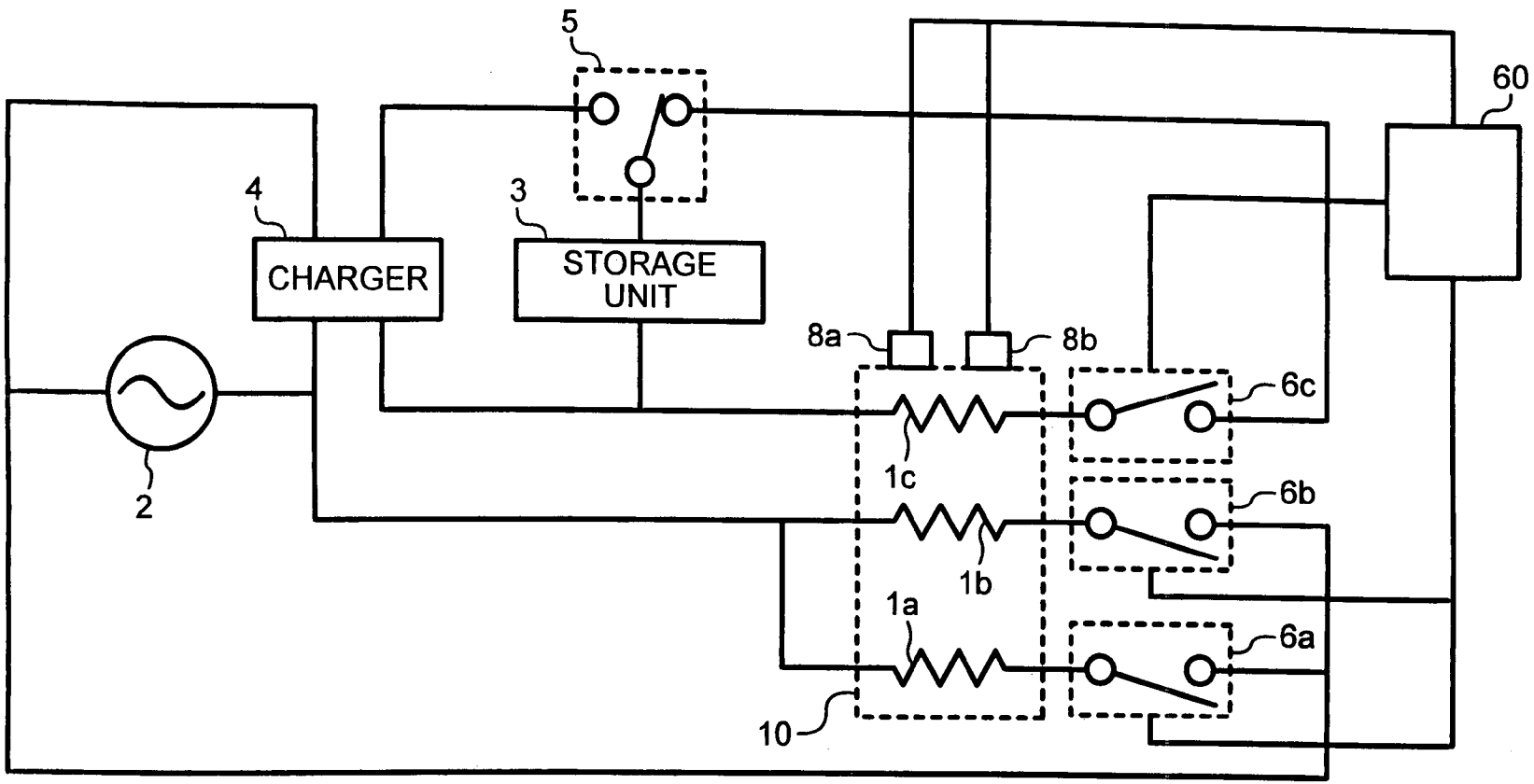
FIG. 4 is a block diagram of an exemplary power supply control circuit structure of the fixing device according to an embodiment of the present invention.

FIG. 4 is a block diagram of an exemplary power supply control circuit structure of the fixing device 10 according to an embodiment of the present invention. In FIG. 4, only a circuit portion involved in power supply to the heating part 1 is illustrated. With reference to FIG. 4, the control circuit of the fixing device 10 includes the main power supply unit 2, the storage unit 3 acting as an auxiliary power supply unit, a charger 4, a charge/discharge switching unit 5, main switching elements 6*a* and 6*b*, an auxiliary switching element 6*c*, and the control unit 60.

The main power supply unit 2 is powered by an external power source such as a commercial power source to feed electric power to each unit of the image forming apparatus when the power switch 120 of the image forming apparatus is turned on. The main power supply unit 2 is configured to feed electric power to each unit of the image forming apparatus by being connected to an outlet 50 of the commercial power source via a plug 51 (shown in FIG. 1). In Japan, the commercial power source is limited to about 100V and 15 A, and the maximum power of the main power supply unit 2 is generally set to about 1500 W. The main power supply unit 2 may have the functions of adjusting the voltage, commutating an alternating current and a direct current, and stabilizing the voltage. The main heating members 1*a* and 1*b* heat by being supplied with power from the main power supply unit 2.

The storage unit 3 acting as an auxiliary power supply unit is formed from an electric double layer capacitor, and is powered by the main power supply unit 2 to supply power to the auxiliary heating member 1*c*. That is, the auxiliary heating member 1*c* is heated via power from the storage unit 3. Instead of the electric double layer capacitor, the storage unit 3 may be formed from a lithium-ion secondary battery, a nickel metal hydride secondary battery, or a pseudocapacitor using redox. As illustrated in FIG. 4, the storage unit 3 is connected to the charger 4, and the charger 4 is connected to the main power supply unit 2. The charger 4 is configured to subject the power supplied from the main power supply unit 2 to a voltage adjustment and an AC/DC conversion, and to supply the power to the storage 20 unit 3. The storage unit 3 supplies the stored power (auxiliary power) to the auxiliary heating member 1*c* via the charge/discharge switching unit 5. The charge/discharge switching unit 5 selectively allows one of the supplying of power from the storage unit 3 to the auxiliary heating member 1*c* and the charging of the storage unit 3 by the charger 4.

The control unit 60 controls the main switching elements 6*a* and 6*b* to switch ON and OFF the power supply from the main power supply unit 2 to the main heating members 1*a* and 1*b*, respectively, and controls the auxiliary switching element 6*c* to switch ON and OFF the power supply from the storage unit 3 to the auxiliary heating member 1*c*. Each of the switching elements 6*a*, 6*b*, and 6*c* may employ any type of control element, such as a field-effect transistor (FET), an insulated gate bipolar transistor (IBBT), and a triac.

As a non-limiting example, the storage unit 3 is formed by a capacitor module made up of a plurality (for example, forty) of electric double-layer capacitor cells connected in series. Each capacitor cell may have a capacitance of approximately 800 F at a rated voltage of 2.5 V, so as to realize a high output voltage of approximately 100 V from the capacitor module. Each capacitor cell may have an internal resistance of about 5 mΩ or less, a diameter of about 35 mm, and a length of about 120 mm. Stable operation of the storage unit 3 can be achieved for a long period of time by providing a voltage balance circuit (not shown) to keep a voltage balance among capacitor cells connected in series. If the internal resistance of each capacitor cell is set to about 5 mΩ or less, the decrease of the voltage between terminals of the storage unit 3 can be less than that of the secondary battery, such as a lithium-ion battery, and a nickel metal hydride battery, even if a large electric current over 20 A flows to the auxiliary heating member 1*c* at the time of warming-up the fixing roller 14. Further, as a large amount of electric power can be obtained from a relatively small number of capacitor cells, the cost and size of the storage unit 3 can be decreased.

The storage unit 3 is chargeable and dischargeable. If the storage unit 3 uses an electric double-layer capacitor which has a large capacity and is not accompanied by chemical reactions, the storage unit 3 can be rapidly charged and its useful lifetime is longer than a secondary battery. In the case of using a nickel-cadmium battery as an auxiliary power supply, which is generally used as a secondary battery, several tens of minutes to several hours may be necessary for charging the nickel-cadmium battery, even if boosting charge is performed. For this reason, a large power can be supplied to units of an apparatus only several times a day, so that the use of the nickel-cadmium battery as an auxiliary power supply may not be currently practical. In contrast, the storage unit 3 if using an ultra capacitor can be charged in about several tens of seconds to several minutes. Thus, the time for charging the storage unit 3 can be lessened. For example, the storage unit 3 using an ultra capacitor can be charged when the main power supply unit 2 can afford to charge the storage unit 3, for example during a non-image forming state of the image forming apparatus. Thus, the number of heating operations, by using the storage unit 3 as the auxiliary power supply unit, can be increased to a more practical number.

The useful lifetime of the nickel-cadmium battery is short because the number of allowable charge-discharge iteration times of the nickel-cadmium battery is currently about 500 to 1000 times. Accordingly, it may be necessary to replace the nickel-cadmium battery very frequently, thereby resulting in the corresponding replacement task and increasing costs for battery replacement. In contrast, the number of allowable charge-discharge iteration times of the capacitor is about 10,000 times or more. Further, the capacitor is not easily deteriorated even if the capacitor is charged and discharged repeatedly. Maintenance of the capacitor is rarely required because the capacitor does not need any liquid exchange or supplement otherwise used in a lead-acid battery.

A capacitor which can store a large amount of electric energy has been developed, so that the use of the capacitor in an electric car is under review. For example, the electric double-layer capacitor developed by Nippon Chemicon Co. has an electrostatic capacitance of about 2000 F at a rated voltage of 2.5 V, which is sufficient for power supply for several seconds to several ten seconds. Further, a capacitor named HYPER CAPACITOR (trade name) manufactured by NEC Corp. has an electrostatic capacitance of about 80 F. Moreover, JEOL Ltd. discloses a NANOGATE CAPACITOR (trade name) which has a voltage proof of about 3.2 to 3.5V and an electric energy density of about 50 to 75 wh/kg.

As described above, the heating part 1 of the fixing roller 14 receives power such that the main heating members 1*a* and 1*b* are supplied with power from the main power supply unit 2 and the auxiliary heating member 1*c* is supplied with power from the storage unit 3. The power from the main power supply unit 2 is supplied to the storage unit 3 through the charger 4, and the storage unit 3 supplies stored power to the auxiliary heating member 1*c* at any arbitrary or desired timing.

Figure 5A:
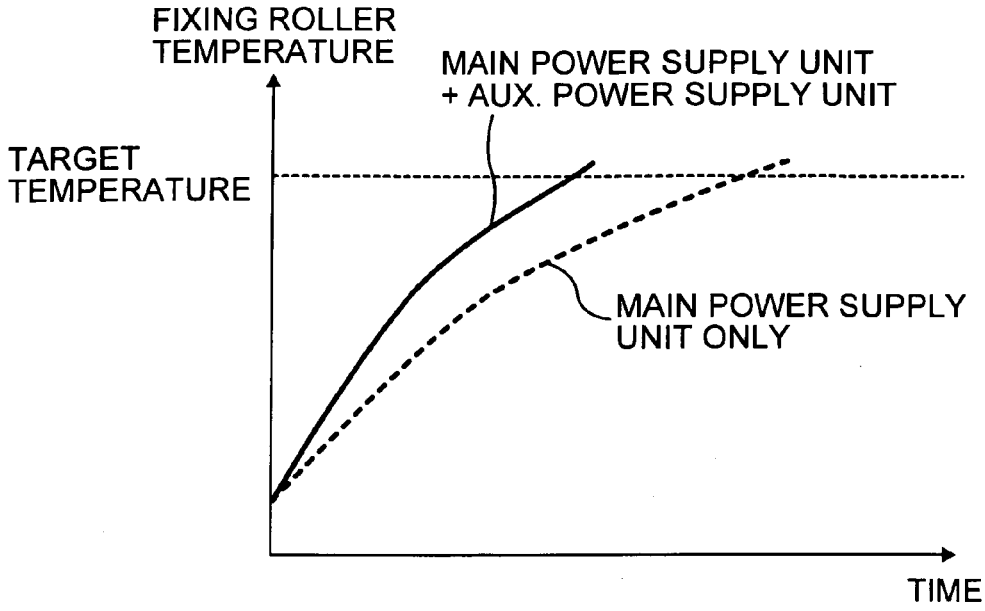
FIG. 5A is a graph showing a variation of a temperature of a fixing roller with time when warming-up the fixing roller according to an embodiment of the present invention.

FIG. 5A is a graph showing a variation of the temperature of the fixing roller 14 with time when warming-up the fixing roller 14 according to an embodiment of the present invention. By supplying power from the storage unit 3 to the heating part 1 in addition to the power supplied from the main power supply unit 2 to the heating part 1, an amount of power greater than the amount of power supplied by the main power supply unit 2 can be supplied to the heating part 1 of the fixing roller 14. Therefore, the warm-up time for raising the temperature of the fixing roller 14 from a room temperature to a target temperature can be decreased by heating the heating part 1 with both the main power supply unit 2 and the storage unit 3, instead of by heating the heating part 1 with only the main power supply unit 2, as illustrated in the graph of FIG. 5A.

Figure 5B:
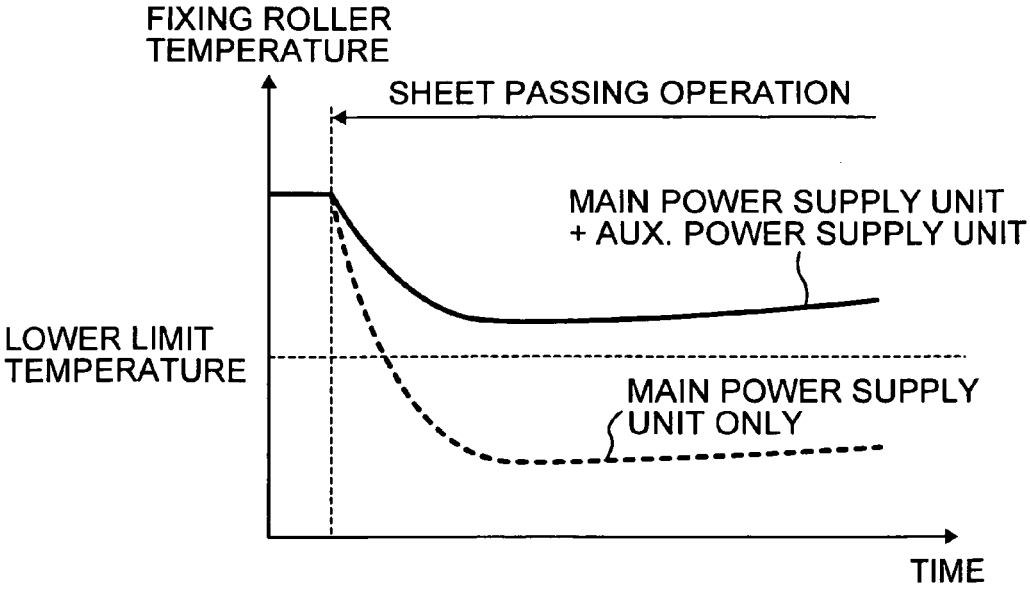
FIG. 5B is a graph showing a variation of the temperature of the fixing roller with time during a sheet passing operation according to an embodiment of the present invention.

FIG. 5B is a graph showing a variation of the temperature of the fixing roller 14 with time during a sheet passing operation according to an embodiment of the present invention. If a plurality of the recording materials P pass through the fixing device 10 consecutively for image fixing (i.e., a sheet passing operation), the recording material P absorbs heat from the fixing roller 14. In this condition, if the heating part 1 is supplied with power from only the main power supply unit 2, the temperature of the fixing roller 14 falls below a predetermined lower limit temperature as illustrated by dotted lines in FIG. 5B. In contrast, by supplying power to the heating part 1 from both the main power supply unit 2 and the storage unit 3, the drop in temperature of the fixing roller 14 can be controlled as illustrated by solid lines in FIG. 5B. By this control, the number of recording materials P passing through the fixing device 10 per unit time can be increased, allowing the image forming apparatus to make copies or prints at a high speed.

Figure 6:
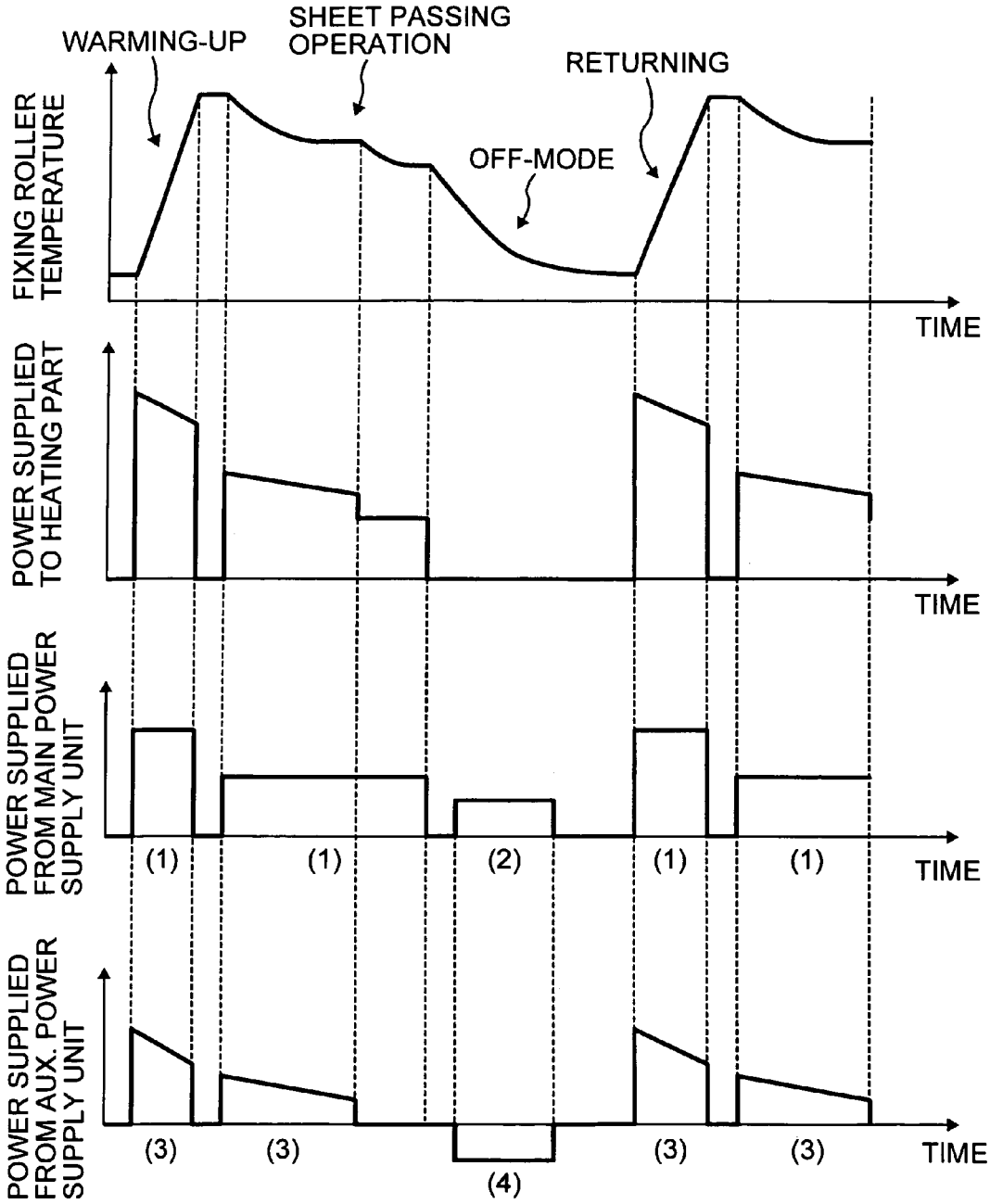
FIG. 6 is a time chart for explaining a power supply operation of the fixing device according to an embodiment of the present invention.

FIG. 6 is a time chart for explaining a power supply operation of the fixing device 10 according to an embodiment of the present invention.

Before warming-up the fixing roller 14 at a startup of the fixing device 10 (i.e., an initial state), the storage unit 3 including, e.g., the electric double-layer capacitor having a large capacity is charged by the external power source through the main power supply unit 2. At the time of warming-up the fixing roller 14, the temperature of the fixing roller 14 is rapidly raised from a room temperature to a target temperature by supplying power to the main heating members 1*a* and 1*b* from the main power supply unit 2, and by supplying power to the auxiliary heating member 1*c* from the storage unit 3. The present inventors carried out experiments under the following conditions:

(1) The fixing roller 14 made of aluminum has a diameter of about 40 mm and a thickness of about 0.7 mm;

(2) The power of about 1200 W is supplied to the main heating members 1*a* and 1*b* from the main power supply unit 2 and the power of about 1200 W is supplied to the auxiliary heating member 1*c* from the storage unit 3. So, a total of about 2400 W power is supplied to the heating part 1 of the fixing roller 14.

According to the experimental results, when the fixing roller 14 was heated by supplying power only to the main heating members 1*a* and 1*b* from the main power supply unit 2, the temperature of the fixing roller 14 was raised from room temperature to a target temperature in about 30 seconds (i.e., a warm-up time). In contrast, when the fixing roller 14 was heated by supplying power to the heating part 1 from both the main power supply unit 2 and the storage unit 3, the warm-up time was reduced to about 15 seconds.

If the storage unit 3 is constructed from a capacitor, the power supplied from the storage unit 3 to the auxiliary heating member 1*c* is gradually decreased from about 1200 W due to the decrease of voltage during supplying power to the auxiliary heating member 1*c*. With this characteristic of the capacitor, the power supplied from the storage unit 3 becomes small after a predetermined time has elapsed. Therefore, even if the temperature of the fixing roller 14 is raised to about 500 degrees centigrade at which the recording material P may ignite, the temperature of the fixing roller 14 gradually decreases due to the above-described characteristic of the capacitor. By using the capacitor as the storage unit 3, the temperature of the fixing roller 14 can be safely raised in a short period of time.

To secure safety, a safety device may be provided in case that the system goes out of control. For example, the safety device may terminate the power supply by cutting off a power supply circuit with a safety circuit, such as a temperature fuse or a thermostat.

The supply of power to the heating part 1 can be increased by using two series of commercial power sources or by using a secondary battery or a fuel battery. However, in this case, a large amount of power is continuously supplied to the heating part 1, so that the warm-up time for raising the temperature of the fixing roller 14 to a target fixing temperature is reduced and the temperature elevation is sharper. In this condition, a safety circuit cannot follow the temperature elevation. When the safety circuit starts to operate, the temperature of the heating part 1 may get too high and cause a recording sheet to ignite. In contrast, in a configuration using a capacitor, even if the system goes out of control and the power supply is not stopped, the heating of the heating member is stopped after a predetermined amount of power stored in the capacitor is used up, and the temperature rise of the heating member is automatically stopped. Thus, the warm-up time for raising the temperature of the fixing roller 14 to a target fixing temperature can be safely reduced by using a capacitor as a power supply.

As the fixing roller 14 is a thin-layered roller, if the number of recording materials P passing through the nip part between the fixing roller 14 and the pressing roller 15 per unit time increases, the surface temperature of the fixing roller 14 typically decreases. However, in the fixing device 10 of the present embodiment, the surface temperature of the fixing roller 14 is prevented from dropping by supplying power from the storage unit 3 to the auxiliary heating member 1*c* in addition to supplying power from the main power supply unit 2 to the main heating members 1*a* and 1*b* during a sheet passing operation as shown in the time chart of FIG. 6. Thus, even if the image forming apparatus is a high-speed machine, the fixing device 10 can achieve a short warm-up time of the fixing roller 14, and can prevent an undesirable drop of the temperature of the fixing roller 14 during a sheet passing operation, while using the thin-layered fixing roller 14.

Further, because the drop of the temperature of the fixing roller 14 after the sheet passage through the fixing device 10 can be prevented, the image forming apparatus according to the embodiment of the present invention can achieve a high-speed image formation, for example 75 copies per minute (CPM). In a background image forming apparatus using a thin-layered fixing roller without performing the power supply from a capacitor during a sheet passing operation, an image formation speed is about 60 CPM at most.

As shown in the time chart of FIG. 6, after performing image forming operations (i.e., the sheet passing operation), the image forming apparatus is put into a stand-by state, specifically, an off-mode, if a next image forming operation is not performed during a predetermined time interval. In the off-mode state, that is, a non-operation state of the image forming apparatus in which the fixing device 10 is not used, the charging of the storage unit 3 is performed. The off-mode is a so-called save-mode, in which the power supply from the main power supply unit 2 and the storage unit 3 to the heating part 1 is stopped under the condition that the power switch 120 of the image forming apparatus is turned on. In the off-mode, the temperature of the fixing roller 14 is controlled to a room temperature, for example about 23 degrees centigrade. In place of the off-mode, a low power mode may be employed, in which the heating part 1 is supplied with low power and the temperature of the fixing roller 14 is controlled to a temperature, for example about 100 degrees centigrade, which is lower than a target fixing temperature, for example about 180 degrees centigrade, in the fixing operation of the fixing device 10. In the off-mode state, the main power supply unit 2 can afford to supply power to the storage unit 3, and the storage unit 3 formed from a capacitor is charged in several minutes. Therefore, the storage unit 3 can be quickly charged for a subsequent warming-up (returning) operation, so that a user need not wait for a long time until a next image forming operation becomes ready.

As described above, by using a capacitor as the storage unit 3 for heating the heating part 1 of the fixing device 10, an advantage which cannot be obtained from a secondary battery can be obtained.

Figure 7:
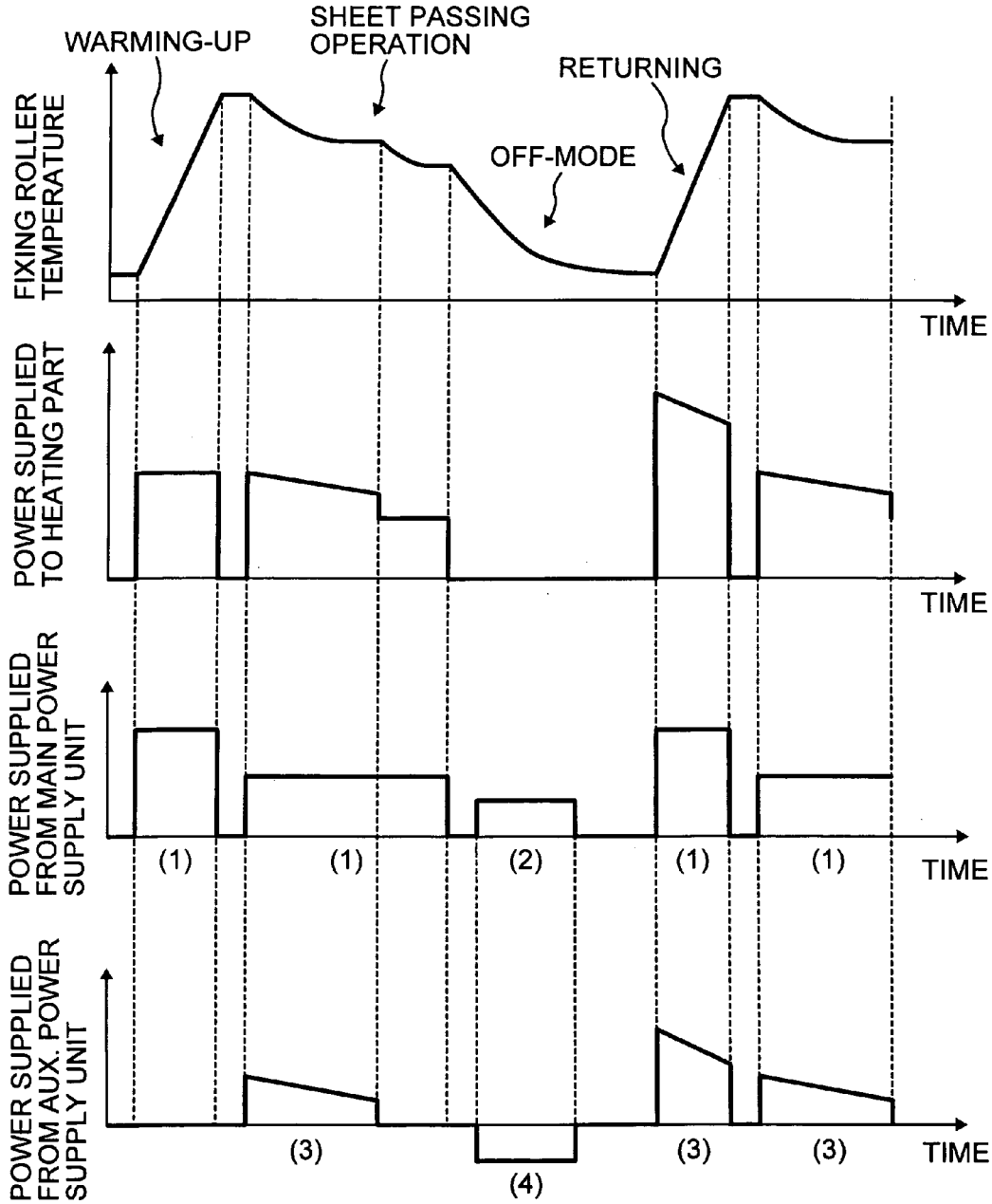
FIG. 7 is a time chart for explaining a power supply operation of the fixing device according to another embodiment of the present invention.

FIG. 7 is a time chart for explaining a power supply operation of the fixing device 10 according to another embodiment of the present invention. In this embodiment, as shown in the time chart of FIG. 7, the storage unit 3 is controlled so as not to supply power to the auxiliary heating members 1*b* during a warming-up period from when the power switch 120 of the image forming apparatus is turned on to when the image forming apparatus becomes ready to start an image forming operation. This control is effective when the power switch 120 of the image forming apparatus is turned on; e.g., in the morning. When the image forming apparatus is started up, time is consumed by the startup operation of the control unit 60 and other units in the image forming apparatus, in addition to the startup operation of the fixing device 10. Therefore, at the startup of the image forming apparatus, there is less need for rapidly warming-up the fixing roller 14. By this control, the power of the storage unit 3 to be supplied to the auxiliary heating member 1*c* at the startup of the fixing device 10 can be saved.

Later, the image forming apparatus is put into a returning period from when the off-mode is completed to when the image forming apparatus becomes ready to start an image forming operation. In the returning period, the heating part 1 is supplied with power from both the main power supply unit 2 and the storage unit 3 to warm-up the fixing roller 14 again, to the target temperature for a next image forming operation. As a result, the temperature of the fixing roller 14 can be quickly raised to the target temperature.

Figure 8A:
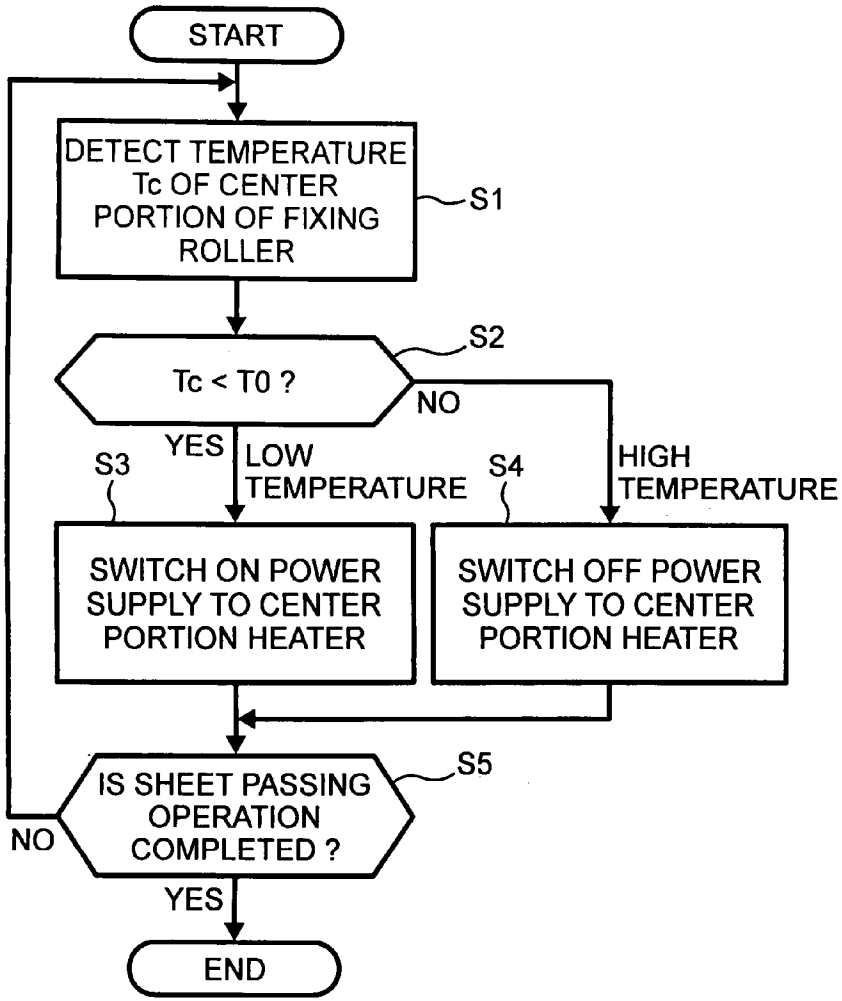
FIGS. 8A through 8C are flowcharts of AC and DC power supply control operation steps of a control unit when a plurality of recording materials each having a large width in a direction perpendicular to a sheet conveying direction consecutively pass through the fixing device according to an embodiment of the present invention.
Figure 8B:
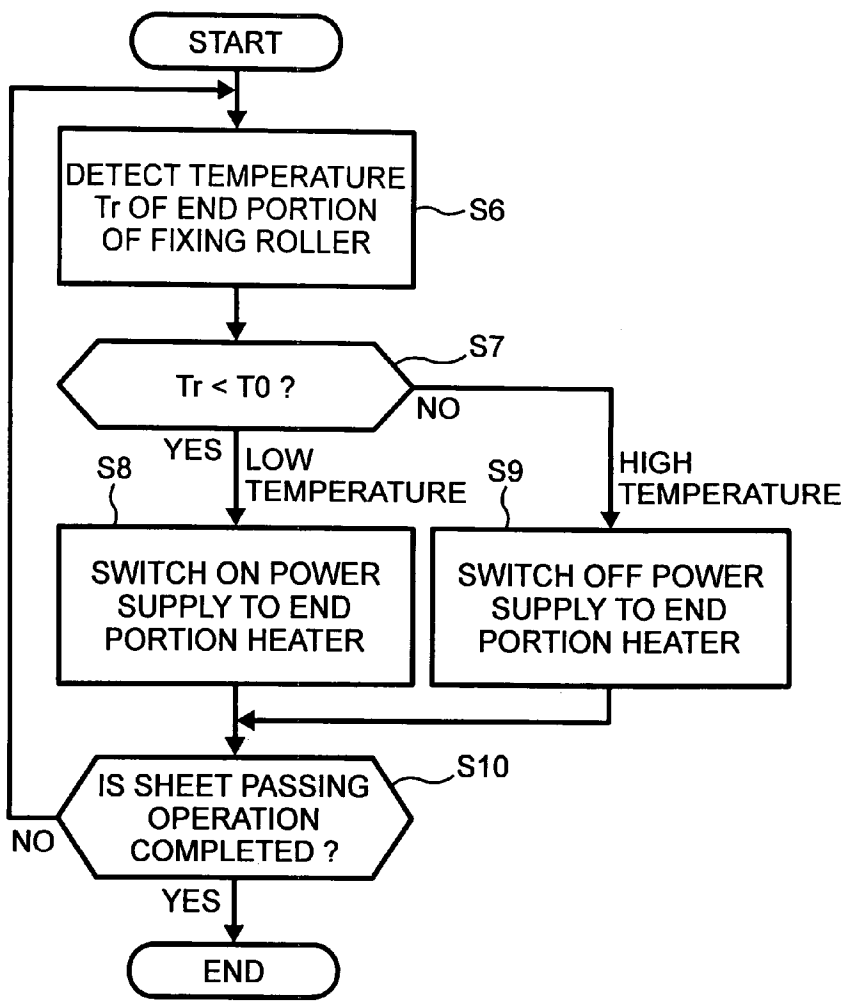
Figure 8C:
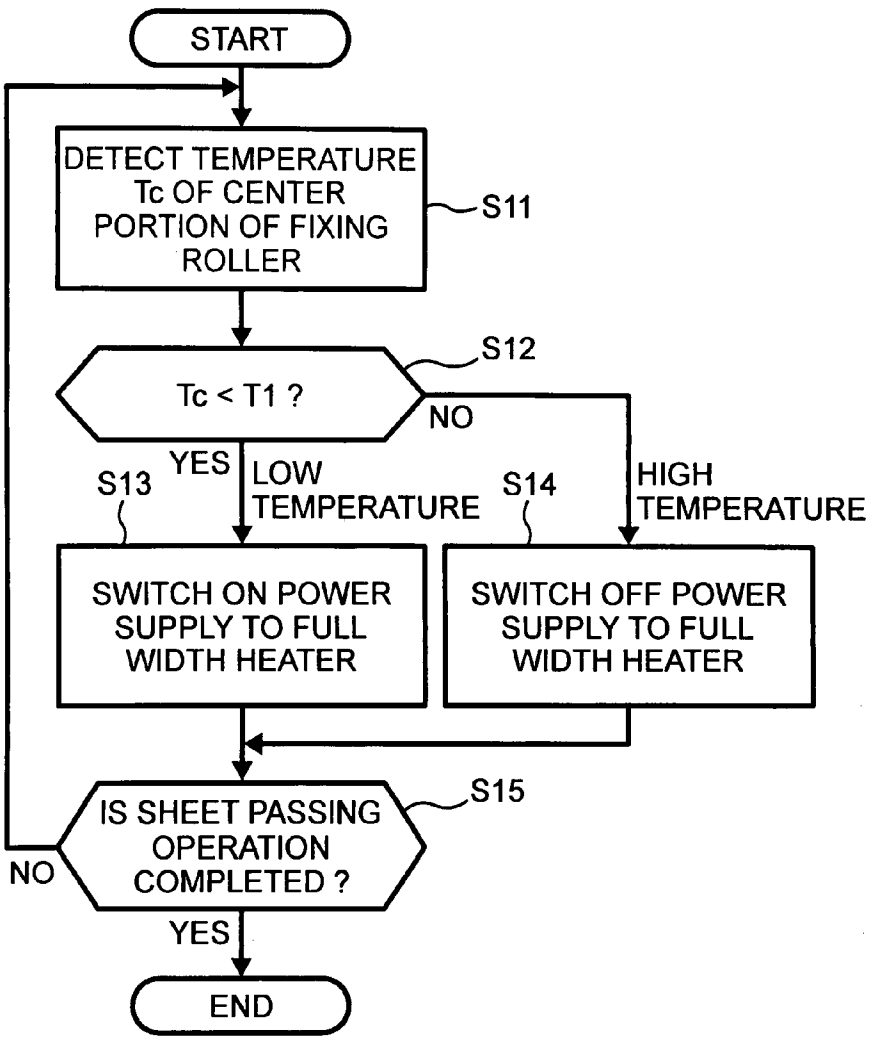

FIGS. 8A through 8C are flowcharts of AC and DC power supply control operation steps of the control unit 60 when a plurality of the recording materials P each having a large width in a direction perpendicular to a sheet conveying direction consecutively pass through the fixing device 10 according to an embodiment of the present invention. Before starting the AC and DC power supply control operation steps of FIGS. 8A through 8C, the size (width) of the recording material P in a direction perpendicular to a sheet conveying direction to be passed through the fixing device 10 is detected by a known technique.

With reference to FIG. 8A, when the recording material P having a large width in a direction perpendicular to a sheet conveying direction passes through the nip part between the fixing roller 14 and the pressing roller 15 during the sheet passing operation, the center portion temperature detecting unit 8*a* detects a temperature Tc of the center portion of the fixing roller 14 in step S1. Then, the control unit 60 determines whether the detected temperature Tc is less than a reference temperature T0 (Tc<T0) in step S2. The reference temperature T0 is set to, for example, about 190 degrees centigrade. If the answer is YES in step S2, the control unit 60 switches ON the power supply from the main power supply unit 2 to the main heating member 1*a* acting as a center portion heater in step S3. If the answer is NO in step S2, the control unit 60 switches OFF the power supply from the main power supply unit 2 to the main heating member 1*a* in step S4. Subsequently, the control unit 60 determines whether the sheet passing operation is completed by a known technique in step S5. If the answer is NO in step S5, the control operation returns to reexecute step S1. If the answer is YES in step S5, the control operation ends.

With reference further to FIG. 8B, when the recording material P having a large width in a direction perpendicular to a sheet conveying direction passes through the nip part between the fixing roller 14 and the pressing roller 15 during the sheet passing operation, the end portion temperature detecting unit 8*b* detects a temperature Tr of the end portion of the fixing roller 14 in step S6. Then, the control unit 60 determines whether the detected temperature Tr is less than the reference temperature T0 (Tr<T0) in step S7. If the answer is YES in step S7, the control unit 60 switches ON the power supply from the main power supply unit 2 to the main heating member 1*b* acting as an end portion heater in step S8. If the answer is NO in step S7, the control unit 60 switches OFF the power supply from the main power supply unit 2 to the main heating member 1*b* in step S9. Subsequently, the control unit 60 determines whether the sheet passing operation is completed in step S10. If the answer is NO in step S10, the control operation returns to reexecute step S6. If the answer is YES in step S10, the control operation ends.

With reference further to FIG. 8C, when the recording material P having a large width in a direction perpendicular to a sheet conveying direction passes through the nip part between the fixing roller 14 and the pressing roller 15 during the sheet passing operation, the center portion temperature detecting unit 8*a* detects the temperature Tc of the center portion of the fixing roller 14 in step S11. Then, the control unit 60 determines whether the detected temperature Tc is less than a reference temperature T1 (Tc<T1) in step S12. The reference temperature T1 is set to, for example, about 180 degrees centigrade. If the answer is YES in step S12, the control unit 60 switches ON the power supply from the storage unit 3 to the auxiliary heating member 1*c* acting as a full width heater in step S13. If the answer is NO in step S12, the control unit 60 switches OFF the power supply from the storage unit 3 to the auxiliary heating member 1*c* in step S14. Subsequently, the control unit 60 determines whether the sheet passing operation is completed in step S15. If the answer is NO in step S15, the control operation returns to reexecute step S11. If the answer is YES in step S15, the control operation ends.

In the AC and DC power supply control operation of FIGS. 8A through 8C, the main heating member 1*a* (the center portion heater) is switched ON and OFF based on a comparison result between the detected center portion temperature Tc and the reference temperature T0. The main heating member 1*b* (the end portion heater) is switched ON and OFF based on a comparison result between the detected end portion temperature Tr and the reference temperature T0. Further, the auxiliary heating member 1*c* (the full width heater) is switched ON and OFF based on a comparison result between the detected center portion temperature Tc and the reference temperature T1. By making the setting temperature value (e.g., about 180 degrees centigrade) for the auxiliary heating member 1*c* (the full width heater) powered by the storage unit 3 acting as the auxiliary power supply unit less than the setting temperature value (e.g., about 190 degrees centigrade) for the main heating member 1*a* (the center portion heater), a loss of power can be decreased.

Figure 9A:
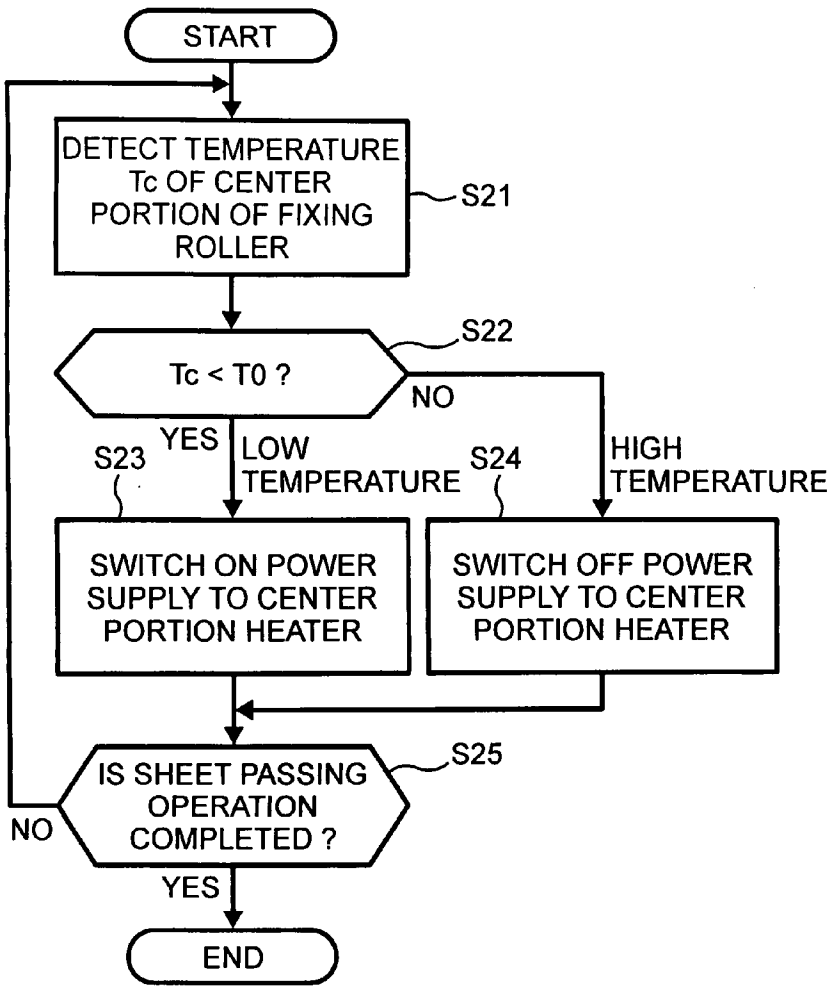
FIGS. 9A through 9C are flowcharts of AC and DC power supply control operation steps of the control unit when a plurality of the recording materials each having a small width in a direction perpendicular to a sheet conveying direction consecutively pass through the fixing device according to an embodiment of the present invention.
Figure 9B:
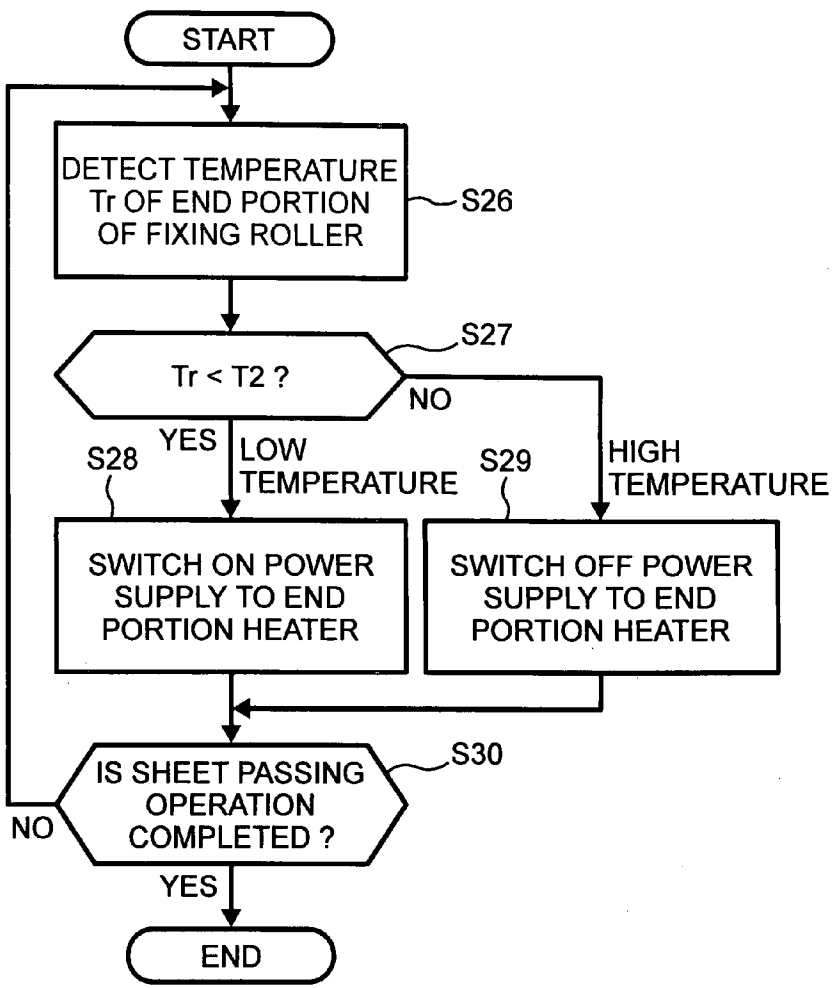
Figure 9C:
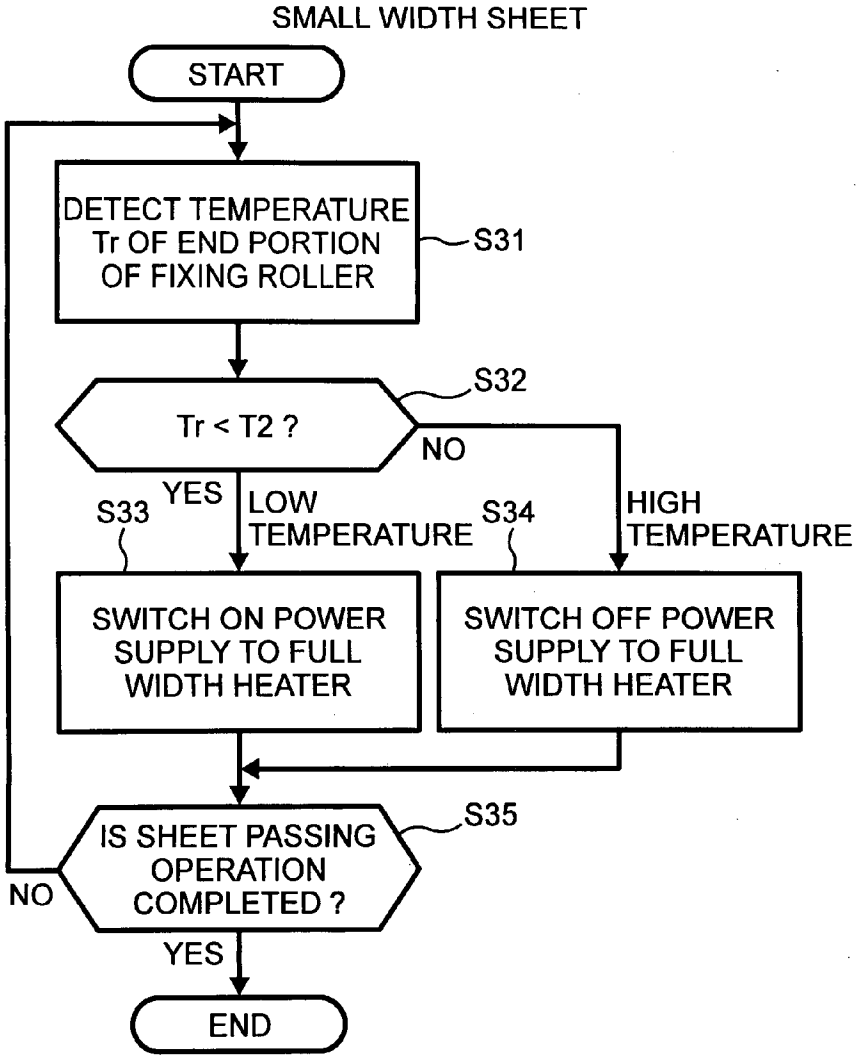

FIGS. 9A through 9C are flowcharts of AC and DC power supply control operation steps of the control unit 60 when a plurality of the recording materials P each having a small width in a direction perpendicular to a sheet conveying direction consecutively pass through the fixing device 10 according to an embodiment of the present invention. Before starting the AC and DC power supply control operation steps of FIGS. 9A through 9C, the size (width) of the recording material P in a direction perpendicular to a sheet conveying direction to be passed through the fixing device 10 is detected by a known technique.

With reference to FIG. 9A, when the recording material P having a small width in a direction perpendicular to a sheet conveying direction passes through the nip part between the fixing roller 14 and the pressing roller 15 during the sheet passing operation, the center portion temperature detecting unit 8*a* detects the temperature Tc of the center portion of the fixing roller 14 in step S21. Then, the control unit 60 determines whether the detected temperature Tc is less than the reference temperature T0 (Tc<T0) in step S22. If the answer is YES in step S22, the control unit 60 switches ON the power supply from the main power supply unit 2 to the main heating member 1*a* (the center portion heater) in step S23. If the answer is NO in step S22, the control unit 60 switches OFF the power supply from the main power supply unit 2 to the main heating member 1*a* in step S24. Subsequently, the control unit 60 determines whether the sheet passing operation is completed by a known technique in step S25. If the answer is NO in step S25, the control operation returns to reexecute step S21. If the answer is YES in step S25, the control operation ends.

With reference further to FIG. 9B, when the recording material P having a small width in a direction perpendicular to a sheet conveying direction passes through the nip part between the fixing roller 14 and the pressing roller 15 during the sheet passing operation, the end portion temperature detecting unit 8*b* detects the temperature Tr of the end portion of the fixing roller 14 in step S26. Then, the control unit 60 determines whether the detected temperature Tr is less than a reference temperature T2 (Tr<T2) in step S27. The reference temperature T2 is set to, for example, about 130 degrees centigrade. If the answer is YES in step S27, the control unit 60 switches ON the power supply from the main power supply unit 2 to the main heating member 1*b* (the end portion heater) in step S28. If the answer is NO in step S27, the control unit 60 switches OFF the power supply from the main power supply unit 2 to the main heating member 1*b* in step S29. Subsequently, the control unit 60 determines whether the sheet passing operation is completed in step S30. If the answer is NO in step S30, the control operation returns to reexecute step S26. If the answer is YES in step S30, the control operation ends.

With reference further to FIG. 9C, when the recording material P having a small width in a direction perpendicular to a sheet conveying direction passes through the nip part between the fixing roller 14 and the pressing roller 15 during the sheet passing operation, the end portion temperature detecting unit 8*b* detects the temperature Tr of the end portion of the fixing roller 14 in step S31. Then, the control unit 60 determines whether the detected temperature Tr is less than the reference temperature T2 (Tc<T2) in step S32. If the answer is YES in step S32, the control unit 60 switches ON the power supply from the storage unit 3 to the auxiliary heating member 1*c* (the full width heater) in step S33. If the answer is NO in step S32, the control unit 60 switches OFF the power supply from the storage unit 3 to the auxiliary heating member 1*c* in step S34. Subsequently, the control unit 60 determines whether the sheet passing operation is completed in step S35. If the answer is NO in step S35, the control operation returns to reexecute step S31. If the answer is YES in step S35, the control operation ends.

In the AC and DC power supply control operation of FIGS. 9A through 9C, the main heating member 1*a* (the center portion heater) is switched ON and OFF based on a comparison result between the detected center portion temperature Tc and the reference temperature T0. Further, each of the main heating member 1*b* (the end portion heater) and the auxiliary heating member 1*c* (the full width heater) is switched ON and OFF based on a comparison result between the detected end portion temperature Tr and the reference temperature T2.

Figure 10A:
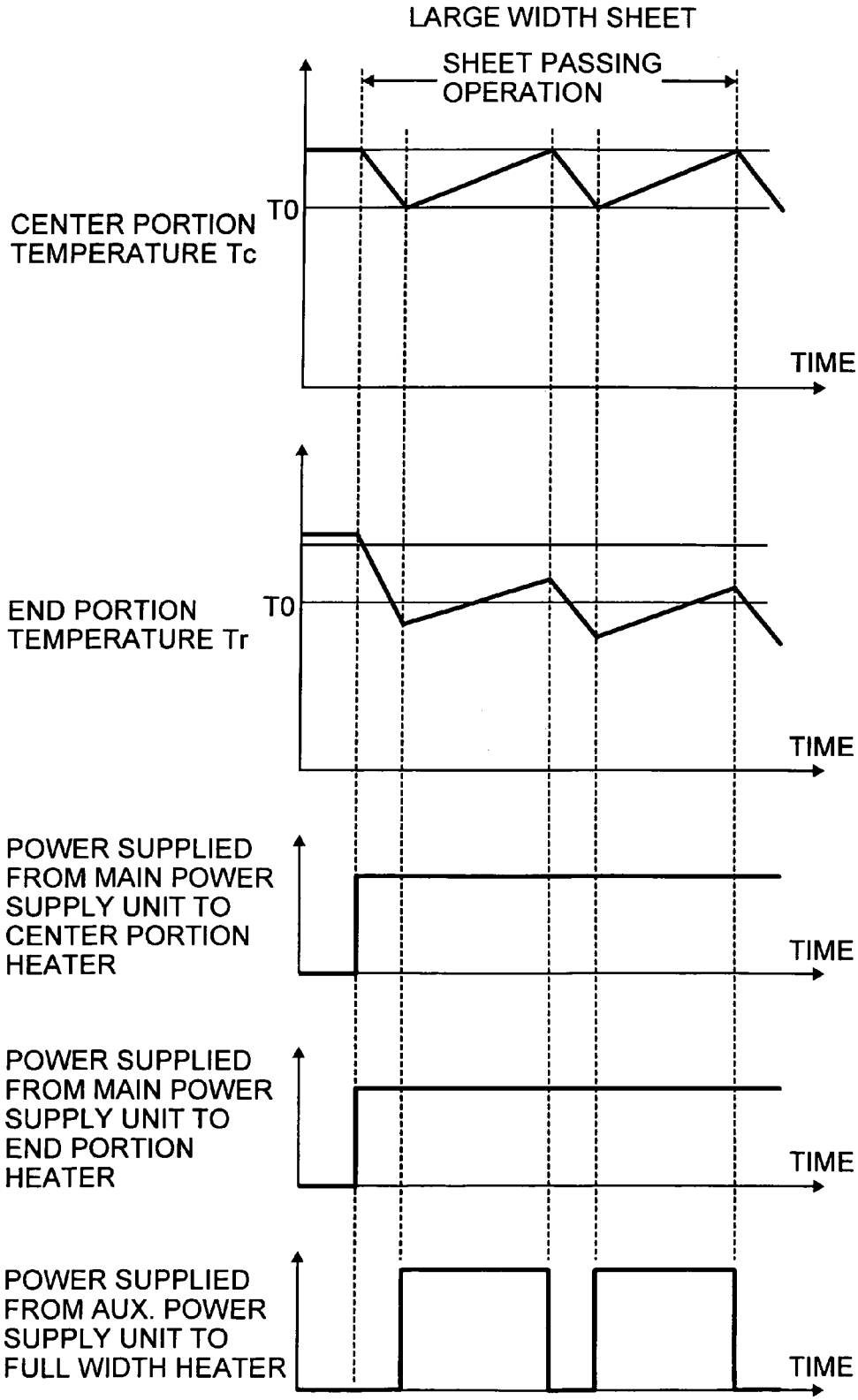
FIG. 10A is a time chart for explaining a power supply operation of the fixing device during a large-width sheet passing operation according to an embodiment of the present invention.

Next, an operation for preventing the end portions of the fixing roller 14 from overheating is described. FIG. 10A is a time chart for explaining a power supply control operation of the fixing device 10 when a plurality of the recording materials P each having a large width in a direction perpendicular to a sheet conveying direction consecutively pass through the fixing device 10 according to an embodiment of the present invention. The time chart of FIG. 10A corresponds to the flowcharts of FIGS. 8A through 8C.

When a plurality of the recording materials P each having a large width in a direction perpendicular to a sheet conveying direction, for example A4 sized sheets in landscape orientation (about 300 mm width), are consecutively printed, the main power supply unit 2 supplies power to the main heating member 1*a* (the center portion heater) according to the temperature Tc of the center portion of the fixing roller 14 detected by the center portion temperature detecting unit 8*a* and supplies power to the main heating member 1*b* (the end portion heater) according to the temperature Tr of the end portion of the fixing roller 14 detected by the end portion temperature detecting unit 8*b*. Further, the storage unit 3 supplies power to the auxiliary heating member 1*c* (the full width heater) according to the temperature Tc of the center portion of the fixing roller 14 detected by the center portion temperature detecting unit 8*a*. When the temperature of the center portion of the fixing roller 14 drops due to heat absorption caused by the recording materials P during the sheet passing operation, the auxiliary heating member 1*c* (the full width heater) heats the substantially full width of the fixing roller 14 by being supplied with power from the storage unit 3. By doing so, the temperature decrease of the fixing roller 14 during the sheet passing operation can be prevented.

Figure 10B:
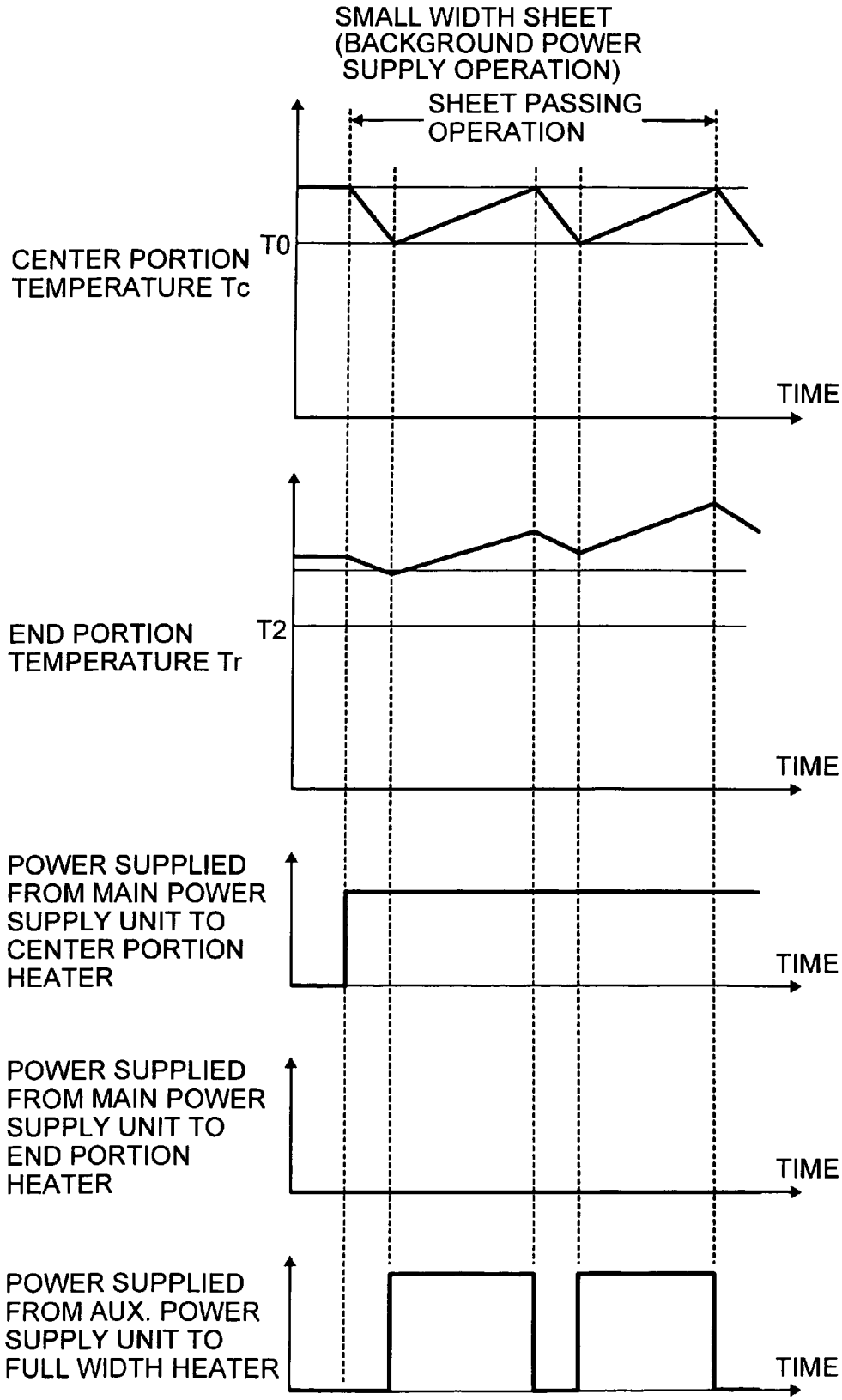
FIG. 10B is a time chart for explaining a background power supply operation of the fixing device during a small-width sheet passing operation.

FIG. 10B is a time chart for explaining a background power supply operation of the fixing device 10 when a plurality of the recording materials P each having a small width in a direction perpendicular to a sheet conveying direction consecutively pass through the fixing device 10. When a plurality of the recording materials P each having a small width in a direction perpendicular to a sheet conveying direction, for example A4 sized sheets in portrait orientation (about 210 mm width), are consecutively printed, the main power supply unit 2 supplies power to the main heating member 1*a* (the center portion heater) according to the temperature Tc of the center portion of the fixing roller 14 detected by the center portion temperature detecting unit 8*a* and supplies power to the main heating member 1*b* (the end portion heater) according to the temperature Tr of the end portion of the fixing roller 14 detected by the end portion temperature detecting unit 8*b*. Further, the storage unit 3 supplies power to the auxiliary heating member 1*c* (the full width heater) according to the temperature Tc of the center portion of the fixing roller 14 which tends to drop due to heat absorption caused by the recording materials P during the sheet passing operation. In this condition, the control unit 60 tends to switch ON the power supply from the storage unit 3 to the auxiliary heating member 1*c* (the full width heater) and the auxiliary heating member 1*c* heats the full width area of the fixing roller 14. As a result, the both end portions of the fixing roller 14 where the recording material P having a small width in a direction perpendicular to a sheet conveying direction does not pass through typically overheat.

Figure 10C:
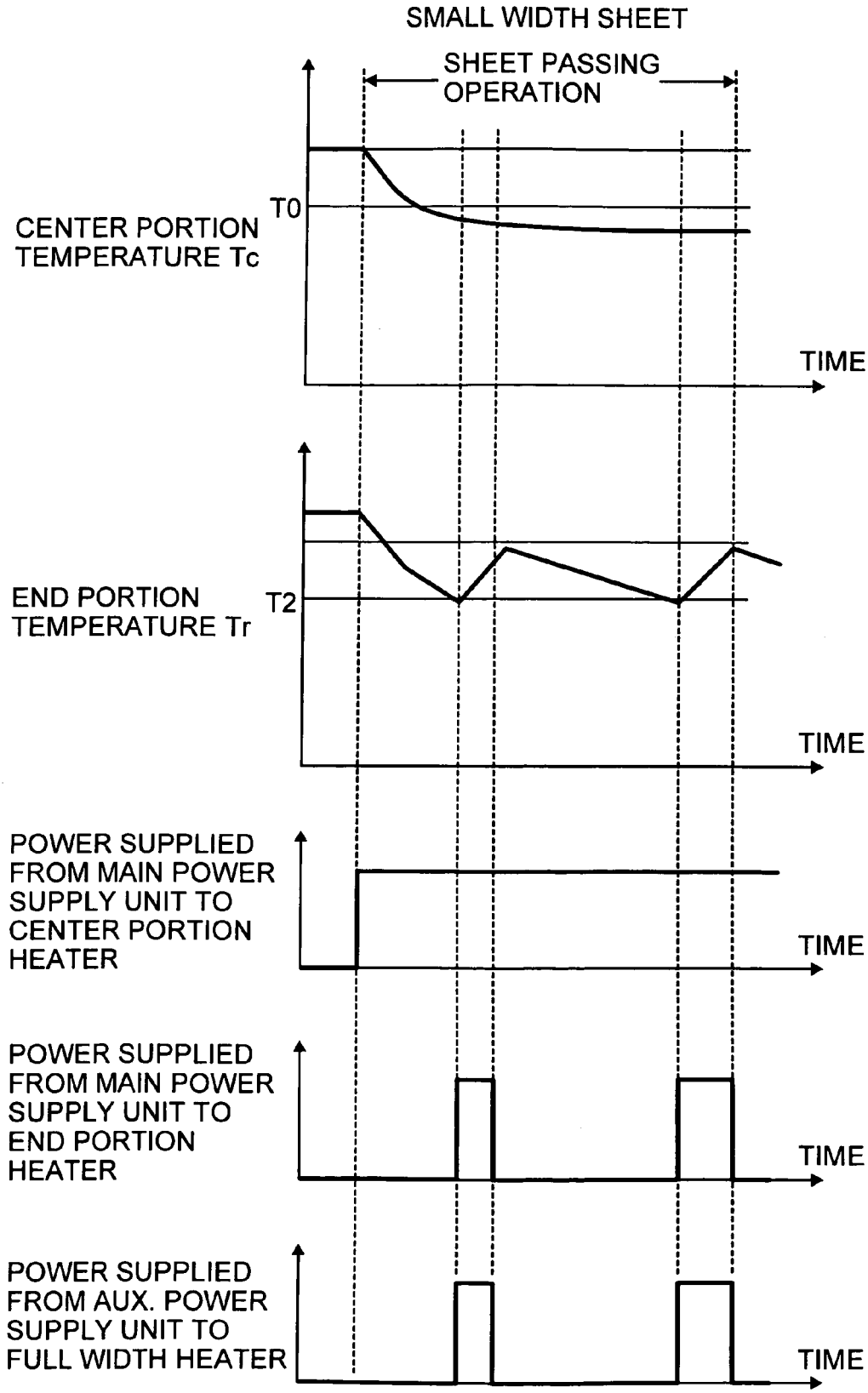
FIG. 10C is a time chart for explaining a power supply operation of the fixing device during a small-width sheet passing operation according to an embodiment of the present invention.

FIG. 10C is a time chart for explaining a power supply operation of the fixing device 10 when a plurality of the recording materials P each having a small width in a direction perpendicular to a sheet conveying direction consecutively pass through the fixing device 10 according to an embodiment of the present invention. The time chart of FIG. 10C corresponds to the flowcharts of FIGS. 9A through 9C. In this embodiment of the present invention, the main power supply unit 2 supplies power to the main heating member 1*a* (the center portion heater) according to the temperature Tc of the center portion of the fixing roller 14 detected by the center portion temperature detecting unit 8*a* and supplies power to the main heating member 1*b* (the end portion heater) according to the temperature Tr of the end portion of the fixing roller 14 detected by the end portion temperature detecting unit 8*b*. Further, the storage unit 3 supplies power to the auxiliary heating member 1*c* (the full width heater) according to the temperature Tr of the end portion of the fixing roller 14 which does not tend to drop because the recording material P having the small width does not contact the end portions of the fixing roller 14 and the heat of the end portions of the fixing roller 14 is not absorbed by the recording material P during the sheet passing operation. In this condition, the control unit 60 does not tend to switch ON the power supply from the storage unit 3 to the auxiliary heating member 1*c* (the full width heater) and the auxiliary heating member 1*c* does not often heat the full width area of the fixing roller 14. As a result, the overheating of the both end portions of the fixing roller 14 where the recording material P having a small width in a direction perpendicular to a sheet conveying direction does not pass through can be controlled.

When a plurality of the recording materials P each having a small width in a direction perpendicular to a sheet conveying direction consecutively pass through the fixing device 10, an amount of heat of the fixing roller 14 absorbed by the recording material P is relatively small. Therefore, as compared to the large-width sheet passing operation, the temperature of the center portion of the fixing roller 14 does not tend to drop significantly even if the center portion of the fixing roller 14 is not heated by the auxiliary heating member 1*c* (the full width heater) powered by the storage unit 3 in the small-width sheet passing operation.

If the temperature of the end portion of the fixing roller 14 decreases and a temperature difference occurs between the relatively high-temperature center portion and the relatively low-temperature end portion of the fixing roller 14 during the small-width sheet passing operation, the temperature of the center portion and the temperature of the end portions of the fixing roller 14 can be made uniform by heating the end portions of the fixing roller 14 by the auxiliary heating member 1*c* powered by the storage unit 3. By doing so, even when a large-width recording material P is passed through the fixing device 10 after a small-width recording material P is passed through the fixing device 10, the delay of start of the large-width sheet passing operation caused by such a temperature difference does not occur.

Figure 11:
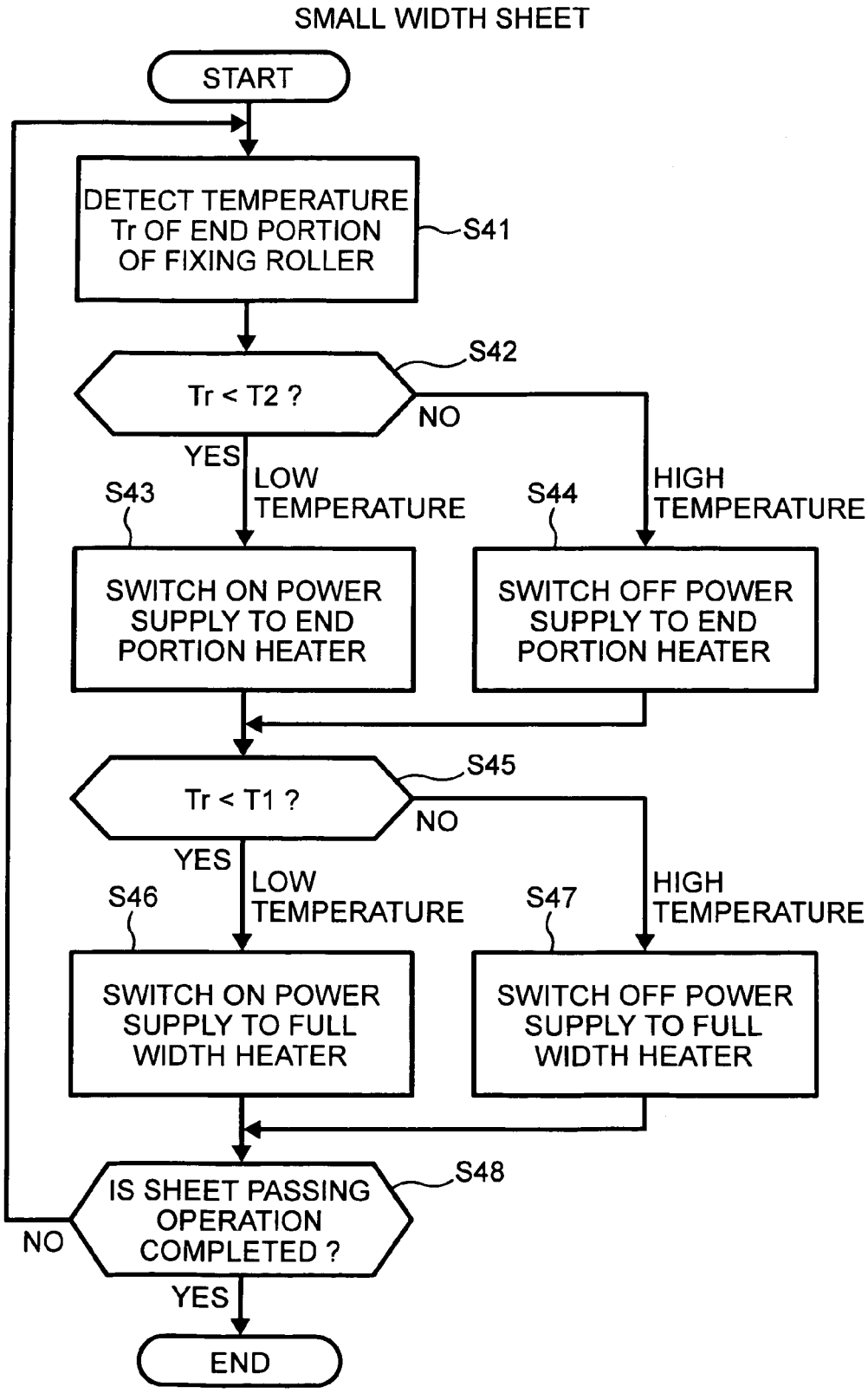
FIG. 11 is a flowchart of AC and DC power supply control operation steps of the control unit during a small-width sheet passing operation according to another embodiment of the present invention.

FIG. 11 is a flowchart of AC and DC power supply control operation steps of the control unit 60 when a plurality of the recording materials P each having a small width in a direction perpendicular to a sheet conveying direction consecutively pass through the fixing device 10 according to another embodiment of the present invention. In the AC and DC power supply control operation of FIGS. 9B and 9C, the setting temperature value (e.g., about 130 degrees centigrade) for the main heating member 1*b* (the end portion heater) is made equal to that for the auxiliary heating member 1*c* (the full width heater). In the AC and DC power supply control operation of FIG. 11, the setting temperature value (e.g., about 130 degrees centigrade) for the main heating member 1*b* (the end portion heater) is different from the setting temperature value (e.g., about 180 degrees centigrade) for the auxiliary heating member 1*c* (the full width heater).

Before starting the AC and DC power supply control operation steps of FIG. 11, the size (width) of the recording material P in a direction perpendicular to a sheet conveying direction to be passed through the fixing device 10 is detected by a known technique.

With reference to FIG. 11, when the recording material P having a small width in a direction perpendicular to a sheet conveying direction passes through the nip part between the fixing roller 14 and the pressing roller 15 during the sheet passing operation, the end portion temperature detecting unit 8*b* detects the temperature Tr of the end portion of the fixing roller 14 in step S41. Then, the control unit 60 determines whether the detected temperature Tr is less than the reference temperature T2 (Tr<T2) in step S42. If the answer is YES in step S42, the control unit 60 switches ON the power supply from the main power supply unit 2 to the main heating member 1*b* (the end portion heater) in step S43. If the answer is NO in step S42, the control unit 60 switches OFF the power supply from the main power supply unit 2 to the main heating member 1*b* in step S44. Subsequently, the control unit 60 determines whether the detected temperature Tr is less than the reference temperature T1 (Tr<T1) in step S45. If the answer is YES in step S45, the control unit 60 switches ON the power supply from the storage unit 3 to the auxiliary heating member 1*c* (the full width heater) in step S46. If the answer is NO in step S45, the control unit 60 switches OFF the power supply from the storage unit 3 to the auxiliary heating member 1*c* in step S47. Then, the control unit 60 determines whether the sheet passing operation is completed in step S48. If the answer is NO in step S48, the control operation returns to reexecute step S41. If the answer is YES in step S48, the control operation ends.

In the AC and DC power supply control operation of FIG. 11, by setting the setting temperature value for the main heating member 1*b* (the end portion heater) to a lower value (e.g., about 130 degrees centigrade), the control unit 60 does not tend to switch ON the power supply from the storage unit 3 to the auxiliary heating member 1*c* (the full width heater) because the auxiliary heating member 1*c* is switched ON and OFF based on a comparison result between the detected end portion temperature Tr and the reference temperature T1 (e.g., about 180 degrees centigrade). As the auxiliary heating member 1*c* does not often heat the full width area of the fixing roller 14, the overheating of the both end portions of the fixing roller 14 where the recording material P having a small width in a direction perpendicular to a sheet conveying direction does not pass through can be also controlled.

As a non-limiting example for an AC and DC power supply control operation when a plurality of the recording materials P each having a small width in a direction perpendicular to a sheet conveying direction consecutively pass through the fixing device 10, the auxiliary heating member 1*c* (the full width heater) may be switched ON and OFF based on a comparison result between the detected center portion temperature Tc and the reference temperature T2 (e.g., about 130 degrees centigrade) which is less than the reference temperature T1 (e.g., about 180 degrees centigrade) for the auxiliary heating member 1*c* used when a plurality of the recording materials P each having a large width in a direction perpendicular to a sheet conveying direction consecutively pass through the fixing device 10. In this example, as compared to the power supply control operation performed during the large-width sheet passing operation, the control unit 60 may not tend to switch ON the power supply from the storage unit 3 to the auxiliary heating member 1*c* because the auxiliary heating member 1*c* is switched ON and OFF based on a lower reference temperature T2 than the reference temperature T1 for the auxiliary heating member 1*c* used during the large-width sheet passing operation.

In the above-described embodiments, the image forming apparatus is put into the off-mode for saving energy if a next image forming operation is not performed during a predetermined time interval after performing the preceding image forming operation (i.e., the sheet passing operation). In the off-mode, each temperature of the center portion and the end portions of the fixing roller 14 decreases. As compared to the center portion of the fixing roller 14, the end portions of the fixing roller 14 tend to dissipate heat due to the contact with gears and side plates in the image forming apparatus.

Therefore, the temperature of the end portions of the fixing roller 14 falls more than that of the center portion of the fixing roller 14.

The present inventors carried out experiments on a warm-up time for raising the temperature of the fixing roller 14 to a target temperature when warming-up the fixing roller 14 in a returning period from when the off-mode is completed to when the image forming apparatus becomes ready to start an image forming operation by performing a conventional DC power supply control operation. According to the experimental results, the temperature of the center portion of the fixing roller 14 was raised to the target temperature in about 10 seconds. In contrast, it took far more than 10 seconds to raise the temperature of the end portions of the fixing roller 14 to the target temperature, so that the temperature of the end portions of the fixing roller 14 cannot be raised to the target temperature within a target warm-up time.

The above experimental results were obtained for the following reasons. In the experiments performing the conventional DC power supply control operation, when warming-up the fixing roller 14 in the returning period, whether to supply power from the storage unit 3 to the auxiliary heating member 1*c* (the full width heater) was determined by comparing the temperature Tc of the center portion of the fixing roller 14 with a reference temperature T3. The reference temperature T3 is set to, for example, about 120 degrees centigrade. As described above, the temperature of the center portion of the fixing roller 14 tends to fall less than that of the end portions of the fixing roller 14 in the off-mode. If the fixing roller 14 is warmed-up in the returning period without supplying power from the storage unit 3 to the auxiliary heating member 1*c* (the full width heater), the temperature of the end portions of the fixing roller 14, which tends to fall more than that of the center portion of the fixing roller 14 in the off-mode, cannot be raised to the target temperature in about 10 seconds due to power shortage. Thus, in a DC power supply control operation of the embodiment of the present invention, whether to supply power from the storage unit 3 to the auxiliary heating member 1*c* (the full width heater) is determined by comparing the temperature Tr of the end portion of the fixing roller 14 with the reference temperature T3.

Figure 12:
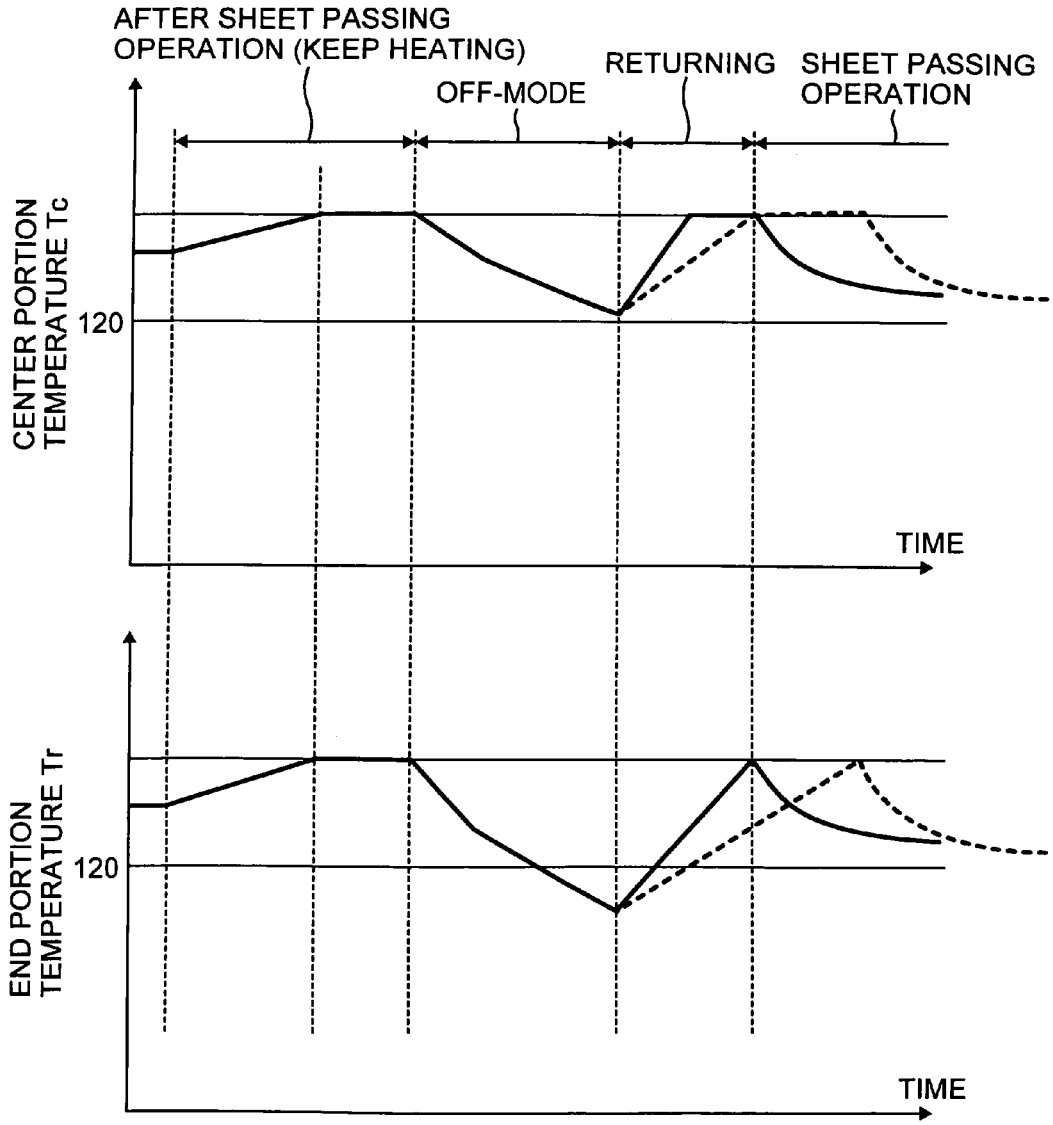
FIG. 12 is a graph showing a variation of a temperature of a center portion of the fixing roller with time and a variation of a temperature of an end portion of the fixing roller with time after a sheet passing operation according to an embodiment of the present invention.

FIG. 12 is a graph showing a variation of the temperature Tc of the center portion of the fixing roller 14 with time and a variation of the temperature Tr of the end portion of the fixing roller 14 with time after a sheet passing operation. In the returning period and a subsequent sheet passing operation period in FIG. 12, solid lines indicate the variation of the temperature of the fixing roller 14 based on the DC power supply control operation according to the embodiment of the present invention in which whether to supply power from the storage unit 3 to the auxiliary heating member 1*c* is determined based on the temperature Tr of the end portion of the fixing roller 14 and the power is supplied from the storage unit 3 to the auxiliary heating member 1*c* when warming-up the fixing roller 14 in the returning period. In contrast, dotted lines indicate the variation of the temperature of the fixing roller 14 based on the conventional DC power supply control operation in which whether to supply power from the storage unit 3 to the auxiliary heating member 1*c* is determined based on the temperature Tc of the center portion of the fixing roller 14 and the power is not supplied from the storage unit 3 to the auxiliary heating member 1*c* when warming-up the fixing roller 14 in the returning period. As indicated by the solid lines in FIG. 12, the temperature Tr of the end portion of the fixing roller 14 can be raised to the target temperature within a target warm-up time in the returning period.

Figure 13:
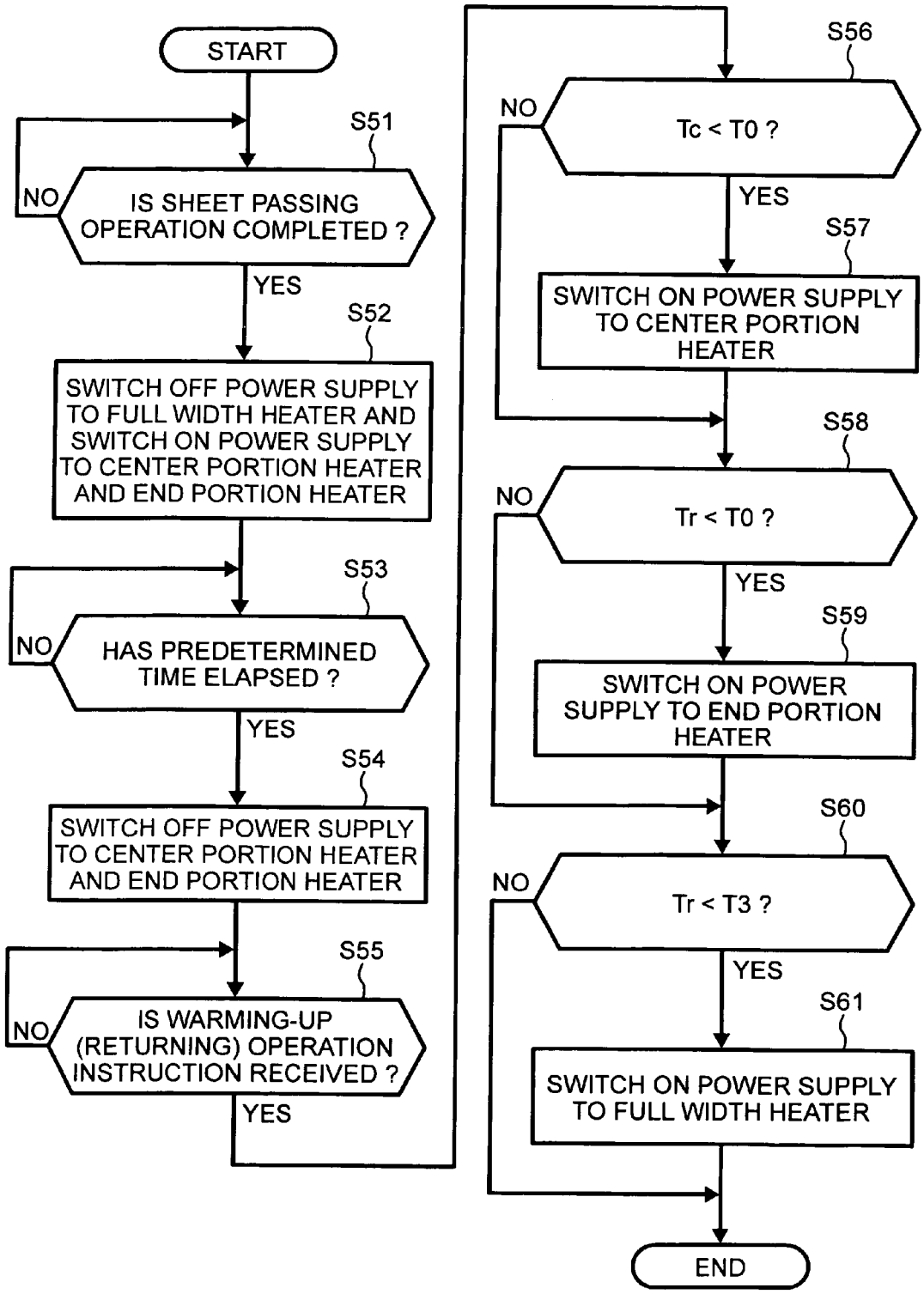
FIG. 13 is a flowchart of AC and DC power supply control operation steps of the control unit when warming-up the fixing roller during a returning period according to an embodiment of the present invention.

FIG. 13 is a flowchart of AC and DC power supply control operation steps of the control unit 60 when warming-up the fixing roller 14 during the returning period according to an embodiment of the present invention. The flowchart of FIG. 13 corresponds to the graph of FIG. 12 illustrated by the solid lines.

First, the control unit 60 determines whether the sheet passing operation is completed in step S51. If the answer is YES in step S51, the control unit 60 switches OFF the power supply from the storage unit 3 to the auxiliary heating member 1*c* (the full width heater) and switches ON (keeps) the power supply from the main power supply unit 2 to the main heating members 1*a* and 1*b* (the center portion heater and end portion heater) in step S52. Then, the control unit 60 determines whether a predetermined time has elapsed since the completion of the sheet passing operation in step S53. If the answer is YES in step S53, the control unit 60 switches OFF the power supply from the main power supply unit 2 to the main heating members 1*a* and 1*b* in step S54. By doing so, the image forming apparatus is put into the off-mode.

Subsequently, the control unit 60 determines whether a warming-up (returning) operation instruction is received in step S55. If the answer is YES in step S55, the control unit 60 determines whether the temperature Tc of the center portion of the fixing roller 14 is less than the reference temperature T0 (Tc<T0) in step S56. If the answer is YES in step S56, the control unit 60 switches ON the power supply from the main power supply unit 2 to the main heating member 1*a* (the center portion heater) in step S57. If the answer is NO in step S56, the control operation proceeds to step S58. In step S58, the control unit 60 determines whether the temperature Tr of the end portion of the fixing roller 14 is less than the reference temperature T0 (Tr<T0). If the answer is YES in step S58, the control unit 60 switches ON the power supply from the main power supply unit 2 to the main heating member 1*b* (the end portion heater) in step S59. If the answer is NO in step S58, the control operation proceeds to step S60. In step S60, the control unit 60 determines whether the temperature Tr of the end portion of the fixing roller 14 is less than the reference temperature T3 (Tr<T3). If the answer is YES in step S60, the control unit 60 switches ON the power supply from the storage unit 3 to the auxiliary heating member 1*c* (the full width heater) in step S61. Then, the control operation ends. If the answer is NO in step S60, the control operation ends as well.

The present invention has been described with respect to the exemplary embodiments illustrated in the figures. However, the present invention is not limited to these embodiments and may be practiced otherwise.

In the above-described embodiments, the control unit 60 controls the power supply from the main power supply unit 2 and the storage unit 3 to the heating part 1 by performing ON and OFF control. Alternatively, the control unit 60 may control the power supply from the main power supply unit 2 and the storage unit 3 to the heating part 1 by performing another control method, such as a control method for adjusting an amount of supply of power per time, for example a PID (Proportional, Integral, Derivative) control.

Numerous additional modifications and variations of the present invention are possible in light of the above teachings. It is therefore understood that within the scope of the appended claims, the present invention may be practiced other than as specifically described herein.

The invention claimed is:

1. A fixing device for fixing an image formed on a recording material, comprising:

a first rotary member and a second rotary member configured to convey the recording material having an image through a nip part formed between the first rotary member and the second rotary member, to thereby fix the image onto the recording material;

a heating part configured to heat the first rotary member, the heating part comprising:

a first heating member configured to heat a first portion of the first rotary member in an axial direction of the first rotary member;

a second heating member configured to heat a second portion of the first rotary member in the axial direction of the first rotary member other than the first portion; and a third heating member configured to heat the first portion and the second portion of the first rotary member;

a center portion temperature detecting unit configured to detect a temperature of a center portion of the first rotary member;

an end portion temperature detecting unit configured to detect a temperature of at least one of end portions of the first rotary member; and a control unit configured to control a heating amount of the heating part, wherein when a plurality of recording materials each having a relatively large width in a direction perpendicular to a conveying direction of the recording material consecutively pass through the nip part between the first rotary member and the second rotary member, the control unit is configured to control the heating amount of the third heating member based on the temperature detected by the center portion temperature detecting unit, and when a plurality of recording materials each having a relatively small width in the direction perpendicular to the conveying direction of the recording material consecutively pass through the nip part between the first rotary member and the second rotary member, the control unit is configured to control the heating amount of the third heating member based on the temperature detected by the end portion temperature detecting unit.

2. The fixing device according to claim 1, wherein when a plurality of recording materials each having a relatively large width in a direction perpendicular to a conveying direction of the recording material consecutively pass through the nip part, the control unit is configured to control the heating amount of the third heating member based on a comparison result between the temperature detected by the center portion temperature detecting unit and a first reference temperature, and when a plurality of recording materials each having a relatively small width in a direction perpendicular to a conveying direction of the recording material consecutively pass through the nip part, the control unit is configured to control the heating amount of the third heating member based on a comparison result between the temperature detected by the end portion temperature detecting unit and a second reference temperature.

3. The fixing device according to claim 2, wherein the second reference temperature is less than the first reference temperature.

4. The fixing device according to claim 1, wherein when a plurality of recording materials each having a relatively large width in a direction perpendicular to a conveying direction of the recording material consecutively pass through the nip part, the control unit is configured to control the heating amount of the second heating member based on a comparison result between the temperature detected by the end portion temperature detecting unit and a third reference temperature, and when a plurality of recording materials each having a relatively small width in a direction perpendicular to a conveying direction of the recording material consecutively pass through the nip part, the control unit is configured to control the heating amount of the second heating member based on a comparison result between the temperature detected by the end portion temperature detecting unit and a fourth reference temperature which is less than the third reference temperature.

5. The fixing device according to claim 2, wherein when a plurality of recording materials each having a relatively small width in a direction perpendicular to a conveying direction of the recording material consecutively pass through the nip part, the control unit is configured to perform ON and OFF control of a heating operation of the third heating member based on the comparison result between the temperature detected by the end portion temperature detecting unit and the second reference temperature.

6. The fixing device according to claim 1, further comprising:

a power storage unit configured to be charged by an external power source and to supply power to the third heating member, wherein each of the first heating member and the second heating member is configured to be supplied with power from the external power source, and when a plurality of recording materials each having a relatively large width in a direction perpendicular to a conveying direction of the recording material consecutively pass through the nip part, the control unit is configured to control the power storage unit to supply power to the third heating member based on the temperature detected by the center portion temperature detecting unit, and when a plurality of recording materials each having a relatively small width in a direction perpendicular to a conveying direction of the recording material consecutively pass through the nip part, the control unit is configured to control the power storage unit to supply power to the third heating member based on the temperature detected by the end portion temperature detecting unit.

7. A fixing device for fixing an image formed on a recording material in an image forming apparatus, comprising:

a first rotary member and a second rotary member configured to convey the recording material having an image through a nip part formed between the first rotary member and the second rotary member, to thereby fix the image onto the recording material;

a power storage unit configured to be charged by an external power source;

a heating part configured to heat the first rotary member, the heating part comprising:

a first heating member configured to heat a first portion portion of the first rotary member in an axial direction of the first rotary member and configured to be supplied with power from the external power source;

a second heating member configured to heat a second portion of the first rotary member in the axial direction of the first rotary member other than the first portion, and configured to be supplied with power from the external power source; and a third heating member configured to heat the first portion and the second portion of the first rotary member and configured to be supplied with power from the storage unit;

a center portion temperature detecting unit configured to detect a temperature of a center portion of the first rotary member;

an end portion temperature detecting unit configured to detect a temperature of at least one of end portions of the first rotary member; and a control unit configured to control a heating amount of the heating part, wherein when the first rotary member is warmed-up by the heating part during a returning period from when a stand-by state of the image forming apparatus is completed to when the image forming apparatus becomes ready to start an image forming operation, the control unit is configured to control power supply from the storage unit to the third heating member based on the temperature detected by the end portion temperature detecting unit.

8. An image forming apparatus, comprising:

an image forming device configured to form an image on a recording material; and a fixing device configured to fix the image formed on the recording material, the fixing device comprising:

a first rotary member and a second rotary member configured to convey the recording material having an image through a nip part formed between the first rotary member and the second rotary member, to thereby fix the image onto the recording material;

a heating part configured to heat the first rotary member, the heating part comprising:

a first heating member configured to heat a first portion of the first rotary member in an axial direction of the first rotary member;

a second heating member configured to heat a second portion of the first rotary member in the axial direction of the first rotary member other than the first portion; and a third heating member configured to heat the first portion and the second portion of the first rotary member;

a center portion temperature detecting unit configured to detect a temperature of a center portion of the first rotary member;

an end portion temperature detecting unit configured to detect a temperature of at least one of end portions of the first rotary member; and a control unit configured to control a heating amount of the heating part, wherein when a plurality of recording materials each having a relatively large width in a direction perpendicular to a conveying direction of the recording material consecutively pass through the nip part between the first rotary member and the second rotary member, the control unit is configured to control the heating amount of the third heating member based on the temperature detected by the center portion temperature detecting unit, and when a plurality of recording materials each having a relatively small width in the direction perpendicular to the conveying direction of the recording material consecutively pass through the nip part between the first rotary member and the second rotary member, the control unit is configured to control the heating amount of the third heating member based on the temperature detected by the end portion temperature detecting unit.

9. The image forming apparatus according to claim 8, wherein when a plurality of recording materials each having a relatively large width in a direction perpendicular to a conveying direction of the recording material consecutively pass through the nip part, the control unit is configured to control the heating amount of the third heating member based on a comparison result between the temperature detected by the center portion temperature detecting unit and a first reference temperature, and when a plurality of recording materials each having a relatively small width in a direction perpendicular to a conveying direction of the recording material consecutively pass through the nip part, the control unit is configured to control the heating amount of the third heating member based on a comparison result between the temperature detected by the end portion temperature detecting unit and a second reference temperature.

10. The image forming apparatus according to claim 9, wherein the second reference temperature is less than the first reference temperature.

11. The image forming apparatus according to claim 8, wherein when a plurality of recording materials each having a relatively large width in a direction perpendicular to a conveying direction of the recording material consecutively pass through the nip part, the control unit is configured to control the heating amount of the second heating member based on a comparison result between the temperature detected by the end portion temperature detecting unit and a third reference temperature, and when a plurality of recording materials each having a relatively small width in a direction perpendicular to a conveying direction of the recording material consecutively pass through the nip part, the control unit is configured to control the heating amount of the second heating member based on a comparison result between the temperature detected by the end portion temperature detecting unit and a fourth reference temperature which is less than the first reference temperature.

12. The image forming apparatus according to claim 9, wherein when a plurality of recording materials each having a relatively small width in a direction perpendicular to a conveying direction of the recording material consecutively pass through the nip part, the control unit is configured to perform ON and OFF control of a heating operation of the third heating member based on the comparison result between the temperature detected by the end portion temperature detecting unit and the second reference temperature.

13. The image forming apparatus according to claim 8, wherein the fixing device further comprises:

a power storage unit configured to be charged by an external power source and to supply power to the third heating member, wherein each of the first heating member and the second heating member is configured to be supplied with power from the external power source, and when a plurality of recording materials each having a relatively large width in a direction perpendicular to a conveying direction of the recording material consecutively pass through the nip part, the control unit is configured to control the power storage unit to supply power to the third heating member based on the temperature detected by the center portion temperature detecting unit, and when a plurality of recording materials each having a relatively small width in a direction perpendicular to a conveying direction of the recording material consecutively pass through the nip part, the control unit is configured to control the power storage unit to supply power to the third heating member based on the temperature detected by the end portion temperature detecting unit.

14. An image forming apparatus, comprising:

an image forming device configured to form an image on a recording material; and a fixing device configured to fix the image formed on the recording material, the fixing device comprising:

a first rotary member and a second rotary member configured to convey the recording material having an image through a nip part formed between the first rotary member and the second rotary member, to thereby fix the image onto the recording material;

a storage unit configured to be charged by an external power source;

a heating part configured to heat the first rotary member, the heating part comprising:

a first heating member configured to heat a first portion of the first rotary member in an axial direction of the first rotary member and configured to be supplied with power from the external power source;

a second heating member configured to heat a second portion of the first rotary member in the axial direction of the first rotary member other than the first portion, and configured to be supplied with power from the external power source; and a third heating member configured to heat the first portion and the second portion of the first rotary member, and configured to be supplied with power from the storage unit;

a center portion temperature detecting unit configured to detect a temperature of a center portion of the first rotary member;

an end portion temperature detecting unit configured to detect a temperature of at least one of end portions of the first rotary member; and a control unit configured to control a heating amount of the heating part, wherein when the first rotary member is warmed-up by the heating part during a returning period from when a stand-by state of the image forming apparatus is completed to when the image forming apparatus becomes ready to start an image forming operation, the control unit is configured to control power supply from the storage unit to the third heating member based on the temperature detected by the end portion temperature detecting unit.

15. An image forming apparatus, comprising:

means for forming an image on a recording material; and means for fixing the image formed on the recording material, the means for fixing comprising:

a first rotary member and a second rotary member configured to convey the recording material having an image through a nip part formed between the first rotary member and the second rotary member, to thereby fix the image onto the recording material;

means for heating the first rotary member, the means for heating comprising:

first means for heating a first portion of the first rotary member in an axial direction of the first rotary member;

second means for heating a second portion of the first rotary member in the axial direction of the first rotary member other than the first portion; and third means for heating the first portion and the second portion of the first rotary member;

first means for detecting a temperature of a center portion of the first rotary member;

second means for detecting a temperature of at least one of end portions of the first rotary member; and means for controlling a heating amount of the means for heating, wherein when a plurality of recording materials each having a relatively large width in a direction perpendicular to a conveying direction of the recording material consecutively pass through the nip part between the first rotary member and the second rotary member, the means for controlling controls the heating amount of the third means for heating based on the temperature detected by the first means for detecting, and when a plurality of recording materials each having a relatively small width in a direction perpendicular to a conveying direction of the recording material consecutively pass through the nip part between the first rotary member and the second rotary member, the means for controlling controls the heating amount of the third means for heating based on the temperature detected by the second means for detecting.

16. An image forming apparatus, comprising:

means for forming an image on a recording material; and means for fixing the image formed on the recording material, the means for fixing comprising:

a first rotary member and a second rotary member configured to convey the recording material having an image through a nip part formed between the first rotary member and the second rotary member, to thereby fix the image onto the recording material;

means for heating the first rotary member, the means for heating comprising:

first means for heating a first portion of the first rotary member in an axial direction of the first rotary member, the first means for heating being supplied with power from an external power source;

second means for heating a second portion of the first rotary member in the axial direction of the first rotary member other than the first portion, the second means for heating being supplied with power from the external power source; and third means for heating the first portion and the second portion of the first rotary member;

means for supplying power to the third means for heating, the means for supplying being charged by the external power source;

first means for detecting a temperature of a center portion of the first rotary member;

second means for detecting a temperature of at least one of end portions of the first rotary member; and means for controlling a heating amount of the means for heating, wherein when the first rotary member is warmed-up by the means for heating during a returning period from when a stand-by state of the image forming apparatus is completed to when the image forming apparatus becomes ready to start an image forming operation, the means for controlling controls power supply from the means for supplying to the third means for heating based on the temperature detected by the second means for detecting.

17. A method of fixing an image formed on a recording material, comprising:

heating a first portion of a first rotary member in an axial direction of the first rotary member by a first portion heating member;

heating a second portion of the first rotary member in the axial direction of the first rotary member by an end portion heating member other than the first portion;

heating the first portion and the second portion of the first rotary member by a third heating member;

conveying the recording material having an image through a nip part formed between the first rotary member and a second rotary member;

detecting a temperature of a center portion of the first rotary member;

detecting a temperature of at least one of end portions of the first rotary member;

first controlling a heating amount of the third heating member based on the detected temperature of the center portion of the first rotary member when a plurality of recording materials each having a relatively large width in a direction perpendicular to a conveying direction of the recording material consecutively pass through the nip part between the first rotary member and the second rotary member; and second controlling the heating amount of the third heating member based on the detected temperature of the at least one of the end portions of the first rotary member when a plurality of recording materials each having a relatively small width in a direction perpendicular to a conveying direction of the recording material consecutively pass through the nip part between the first rotary member and the second rotary member.

18. The method according to claim 17, wherein the first controlling comprises controlling the heating amount of the third heating member based on a comparison result between the detected temperature of the center portion of the first rotary member and a first reference temperature, and the second controlling comprises controlling the heating amount of the third heating member based on a comparison result between the detected temperature of the at least one of the end portions of the first rotary member and a second reference temperature.

19. The method according to claim 18, further comprising:

third controlling the heating amount of the second heating member based on a comparison result between the detected temperature of the at least one of the end portions of the first rotary member and a third reference temperature when a plurality of recording materials each having a relatively large width in a direction perpendicular to a conveying direction of the recording material consecutively pass through the nip part, and fourth controlling the heating amount of the second heating member based on a comparison result between the detected temperature of the at least one of the end portions of the first rotary member and a fourth reference temperature when a plurality of recording materials each having a relatively small width in a direction perpendicular to a conveying direction of the recording material consecutively pass through the nip part.

20. A method of fixing an image formed on a recording material in an image forming apparatus, comprising:

charging a power storage unit by an external power source;

heating a first portion of a first rotary member in an axial direction of the first rotary member by a first portion heating member;

heating a second portion of the first rotary member in the axial direction of the first rotary member by a second heating member;

heating the first portion and the second portion of the first rotary member by a third heating member;

supplying power to the third heating member from the power storage unit;

conveying the recording material having an image through a nip part formed between the first rotary member and a second rotary member;

detecting a temperature of a center portion of the first rotary member;

detecting a temperature of at least one of end portions of the first rotary member; and controlling power supply from the storage unit to the third heating member based on the detected temperature of the at least one of the end portions of the first rotary member when the first rotary member is warmed-up during a returning period from when a stand-by state of the image forming apparatus is completed to when the image forming apparatus becomes ready to start an image forming operation.

* * * * *